US012650015B2

(12) United States Patent
Buehler

(10) Patent No.: US 12,650,015 B2
(45) Date of Patent: Jun. 9, 2026

(54) PROFILED SECTION FOR TEMPERATURE-CONTROL OF A ROOM, AND BUILDING ELEMENT ASSEMBLY COMPRISING SAID PROFILED SECTION

(71) Applicant: Armin Buehler, Markt Rettenbach (DE)

(72) Inventor: Armin Buehler, Markt Rettenbach (DE)

( * ) Notice: Subject to any disclaimer, the term of this patent is extended or adjusted under 35 U.S.C. 154(b) by 843 days.

(21) Appl. No.: 17/275,825

(22) PCT Filed: Sep. 16, 2019

(86) PCT No.: PCT/EP2019/074747
§ 371 (c)(1),
(2) Date: Mar. 12, 2021

(87) PCT Pub. No.: WO2020/053449
PCT Pub. Date: Mar. 19, 2020

(65) Prior Publication Data

US 2022/0042305 A1 Feb. 10, 2022

(30) Foreign Application Priority Data

Sep. 16, 2018 (DE) ..... 10 2018 007 266.6
Feb. 5, 2019 (DE) ..... 10 2019 000 797.2

(51) Int. Cl.
*E04B 9/06* (2006.01)
*E04B 9/00* (2006.01)
(Continued)

(52) U.S. Cl.
CPC ..... *E04B 9/06* (2013.01); *E04B 9/006* (2013.01); *F24D 3/165* (2013.01); *F24D 13/024* (2013.01);
(Continued)

(58) Field of Classification Search
CPC . E04B 9/06; E04B 9/006; E04B 9/241; E04B 5/48; F24D 3/165; F24D 13/024;
(Continued)

(56) References Cited

U.S. PATENT DOCUMENTS 2,701,998 A * 2/1955 Wulle ..... F24F 13/068 165/57
2,718,383 A * 9/1955 Frenger ..... F24D 3/165 165/56
(Continued)

FOREIGN PATENT DOCUMENTS

CH 712370 10/2017
CH 712370 A1 * 10/2017 ..... F24F 5/0092
(Continued)

OTHER PUBLICATIONS

"DE_7834640_U1_I—Machine Translation.pdf", machine translation, EPO.org, Dec. 12, 2023. (Year: 2023).*

*Primary Examiner* — Steven B McAllister
*Assistant Examiner* — John E Bargero
(74) *Attorney, Agent, or Firm* — Loginov & Associates, PLLC; William A. Loginov

(57) ABSTRACT

The disclosure describes a profiled section for temperature-control of a room, said section having a receiving portion for a piping system positioning aid, a sealing surface, formed at least at the side of the receiving portion, and at least one first support for a sealing panel, the first support being formed at the side of the receiving portion and pointing in the opposite direction to the sealing surface. The invention also relates to a building element assembly comprising a profiled section of this type and to an associated use.

16 Claims, 17 Drawing Sheets

(51) Int. Cl.
*F24D 3/16* (2006.01)
*F24D 13/02* (2006.01)
*F24D 19/10* (2006.01)
*E04B 9/24* (2006.01)

(52) U.S. Cl.
CPC ..... *F24D 19/1009* (2013.01); *F24D 19/1096* (2013.01); *E04B 9/241* (2013.01); *F24D 2220/006* (2013.01)

(58) Field of Classification Search
CPC ..... F24D 19/1009; F24D 2220/006; F24F 5/0092; F24F 5/0089; F28F 9/012–013
USPC ..... 237/2 A
See application file for complete search history.

(56) References Cited

U.S. PATENT DOCUMENTS 2,782,006 A * 2/1957 Frenger ..... F24D 3/165 165/56
2,845,252 A * 7/1958 Parkinson ..... F24D 3/165 165/56
2,919,117 A * 12/1959 Hoffman ..... F24D 3/165 165/56
4,646,500 A * 3/1987 Smith ..... F24D 3/165 52/506.03
4,766,951 A * 8/1988 Bergh ..... F24D 3/165 165/56
6,910,526 B1 * 6/2005 Sokolean ..... F24F 5/0089 165/56
2004/0031590 A1 * 2/2004 Vilia ..... F24D 3/165 165/81
2004/0148894 A1 * 8/2004 Kelley ..... E04B 9/241 52/506.01
2005/0040152 A1 * 2/2005 Koschenz ..... F28D 20/023 392/339
2006/0027356 A1 * 2/2006 Sulzer ..... F24D 3/125 165/53
2008/0164009 A1 * 7/2008 Chong ..... F24D 13/02 165/104.19
2008/0264602 A1 * 10/2008 Newberry ..... F24D 3/165 165/56
2010/0126707 A1 * 5/2010 Miyamura ..... F24D 3/165 165/168
2011/0056666 A1 * 3/2011 Bonomi ..... F24D 3/16 165/168
2012/0125562 A1 * 5/2012 Mohmeyer ..... F24D 3/148 165/57
2013/0168040 A1 * 7/2013 Guckert ..... F24F 5/0089 165/53
2013/0192793 A1 * 8/2013 Guckert ..... F28D 20/023 165/49
2017/0082252 A1 * 3/2017 Casement ..... G02B 6/0051
2019/0249425 A1 * 8/2019 Tschiersch ..... E04B 1/948

FOREIGN PATENT DOCUMENTS

DE 1912396 9/1970
DE 1912396 A1 9/1970
DE 1946011 3/1971
DE 1946011 A1 3/1971
DE 7834640 U 3/1979
DE 7834640 U1 3/1979
DE 8815347 U 2/1989
DE 8815347 U1 2/1989
DE 20110187 U 8/2001
DE 20110187 U1 8/2001
DE 20304344 U 5/2003
DE 20304344 U1 5/2003
DE 102010014863 10/2011
DE 202014000931 U 5/2014
JP 10232035 A * 9/1998 ..... F24D 3/165

* cited by examiner 10
40
50
52
60
45
70
25
20
30
15
32
57
59

10
40
10
200
200
60
60
200
10
10
52
50
40
60
45
70
25
60
20
30
32
15
10
50
40
45
70
25
20
30

10
40

200
10
200
200
10
200

10
52
50
40
60
45
70
25
60
20
30
32

15
50
40
45
70
25
20
30
10

400
410
420
430

PROFILED SECTION FOR TEMPERATURE-CONTROL OF A ROOM, AND BUILDING ELEMENT ASSEMBLY COMPRISING SAID PROFILED SECTION

The invention relates to a profiled section for temperature-controlling a room, to a building element assembly having such a profiled section, as well as to an associated use.

Installations for temperature-controlling rooms are known in principle. These installations can be configured as a radiant ceiling heating, for example, wherein a building ceiling can serve as a heat or cold reservoir, for example.

It is an object of the invention to specify an alternative embodiment of a known system. This is achieved according to the invention by the subject matter of the main claims.

The invention relates to a profiled section for temperature-controlling a room. This profiled section has a receptacle for a pipe register. Said profiled section has an end face which is configured so as to be at least lateral to the receptacle. Moreover, said profiled section has at least a first contact face for an end plate, wherein the first contact face is configured so as to be lateral to the receptacle and points in a direction counter to that of the end face.

Such a profiled section can serve as a fastening for end plates as well as for temperature-controlling and thus offers a particularly simple embodiment.

It is to be mentioned that, alternatively, an embodiment without any contact face or contact faces for end plates may be provided, in particular in the context of being used on a wall or a floor.

The end face can be configured so as not only to be lateral to the receptacle or receptacles, but in certain embodiments also so as to be directly below the receptacle or receptacles.

The profiled section furthermore preferably has a second contact face for a further end plate. The second contact face in terms of the receptacle can in particular be disposed opposite the first contact face and can point in the direction counter to that of the end face. On account thereof, end plates can be fastened in a simple manner on both sides of the profiled section, this facilitating the configuration of a planar structure.

The profiled section can in particular be configured as an extruded profiled section, as a rolled profiled section or as a folded profiled section. This permits a simple and cost-effective production.

It is preferably provided that only one respective planar portion is configured between each contact face and the end face. Such a planar portion is easy to produce and saves space; moreover, such a planar portion permits a low thermal resistance.

The receptacle can in particular have an opening toward the end face. This permits an easy insertion of the pipe register, for example by pushing the latter in after the profiled section has been assembled.

The opening of the receptacle can in particular have a cover. This permits a corresponding lower side to be produced.

According to one embodiment it is provided that a pipe register is disposed in the receptacle. Said pipe register can in particular be prefabricated; for example, said pipe register can be configured conjointly with the production of the profiled section and thus permits a high level of integration and a simple production of the composite of the profiled section and the pipe register.

According to one embodiment, the pipe register can be disposed so as to be longitudinally flush with the profiled section. However, the pipe register can also be disposed so as to project beyond the pipe register.

According to one embodiment, the pipe register can be fixedly configured in the receptacle. This permits a high level of integration and a minor space requirement and assembly complexity.

The profiled section can furthermore have a further receptacle for a pipe register. It can thus be provided that two pipe registers are used, or that two strands or portions of a pipe register are used. The thermal transmission can thus be improved, or additional functional capabilities can be implemented.

The further receptacle in terms of shape can be configured so as to be identical or mirror inverted to the receptacle. This permits a simple embodiment.

The profiled section can furthermore have a mounting for a heating wire. Separate electric heating which can ensure heating in addition to heating by a pipe register can be provided on account of such a heating wire, for example.

A heating wire can be received in the mounting. Said heating wire can be embodied so as to be prefabricated, for example, this enabling a simple production and use.

The profiled section can furthermore have a groove for receiving an illumination means. The groove can in particular be open toward the end face. An illumination means can be integrated on account thereof, the latter in this way being able to be provided in a particularly simple manner.

The groove can in particular extend in the same direction as the receptacle or the receptacles. This can mean, for example, that enclosed regions of the groove or of the receptacles, respectively, extend in the same direction, for example when viewed from the contact faces.

An illumination means can in particular be disposed in the groove. Said illumination means can be configured so as to be prefabricated, for example, this enabling particularly simple assembling.

The illumination means can in particular be an LED illumination means. This has proven to be particularly energy-saving and durable.

Heat from the illumination means or from the groove can in particular be dischargeable by means of the pipe register. This permits cooling of the illumination means, which extends the service life of the latter.

The profiled section can in particular be configured as a cooling member of the illumination means. This permits double use, specifically for temperature-controlling a room and for discharging heat from the illumination means.

The profiled section can in particular have a constant cross section. This permits a simple production.

The profiled section preferably has a number of one or a plurality of retaining webs which extend in a direction counter to that of the end face. Retaining webs of this type can be configured in parallel, for example, or so as to be completely straight and/or partially hook-shaped. The retaining webs permit the profiled section to be fastened to a structured disposed thereon of, for example.

According to a respective embodiment, it can be provided that the profiled section is configured from two materials or from more than two materials. This permits the use of optimized materials.

The profiled section can be configured in two production steps or in more than two production steps, for example. On account thereof, different production methods which are optimized for a respective purpose can be used.

The invention furthermore relates to a building element assembly. The building element assembly has a building element. The building element assembly furthermore has an insulation assembly and a number of one or a plurality of profiled sections as described herein. The profiled sections are fastened or suspended so as to be spaced apart from the building element such that the insulation assembly is disposed between the building element and the profiled sections.

The advantages of a profiled section as have already described further above can be utilized for a typical application by means of such a building element assembly. The building element and the profiled sections can at least to some extent be thermally decoupled on account of the insulation assembly. It can be achieved on account thereof, for example, that the building element can be used as a thermal storage into which more thermal energy than is momentarily required can also be incorporated. The thermal energy can be released to a room by way of the insulation assembly, for example, since there is always a certain degree of transmission through an insulation as long as the latter is exposed to a temperature differential.

The building element can in particular be a building ceiling, a concrete ceiling, a building wall, or a concrete wall. These have proven advantageous for storing thermal energy. The profiled sections can in principle be disposed below as well as above a building ceiling, or else on a building wall. Moreover, a concrete ceiling or a concrete wall enables an integration in an existing building, for example. However, other types of building ceilings or building walls, for example timber ceilings or timber walls, can also be used.

For example, the insulation assembly can be entirely or partially configured from foam material, from plastics material, as a filling, or from an insulation material. Embodiments of this type have proven to be simple and effective; other embodiments are however also possible.

The insulation assembly can also be entirely or partially configured as an air space. This enables a thermal insulation at a particularly low weight.

The building element assembly can in particular have a number of one or a plurality of end plates. The end plates can bear on the contact faces of the profiled sections. This enables a simple embodiment. For example, a lower side of the building element assembly can in this way be formed by a sequence of profiled sections and end plates, this enabling a positive visual appeal.

For example, the end plates and the profiled sections conjointly can form a downward visible side of the building element assembly. However, other elements can also be used herein, for example so as to achieve another visual appeal or an additional functional capability.

The profiled sections in terms of area can account for between 8% and 100% of the building element assembly, for example. However, other values can also be used to this end. For example, the lower limit may also be 10%, 20%, 30%, 40%, 50%, 60%, 70%, 80%, or 90%. For example, the upper limit may also be 10%, 20%, 30%, 40%, 50%, 60%, 70%, 80%, or 90. All mentioned lower limits can be combined with respective higher upper limits mentioned.

The insulation assembly can in particular have a thermal transmission coefficient of 0.1 $W/m^2K$ to 10 $W/m^2K$. However, other values can also be used to this end. For example, the lower limit may also be 0.5 $W/m^2K$, 1 $W/m^2K$, 2 $W/m^2K$, 3 $W/m^2K$, 4 $W/m^2K$, 5 $W/m^2K$, 6 $W/m^2K$, 7 $W/m^2K$, 8 $W/m^2K$, or 9 $W/m^2K$ sein. For example, the upper limit may also be 0.5 $W/m^2K$, 1 $W/m^2K$, 2 $W/m^2K$, 3 $W/m^2K$, 4 $W/m^2K$, 5 $W/m^2K$, 6 $W/m^2K$, 7 $W/m^2K$, 8 $W/m^2K$, or 9 $W/m^2K$ sein. All mentioned lower limits can be combined with respective higher upper limits mentioned.

The heat permeability of the insulation assembly can in particular be calculated as a function of the temperature of the building element, thus for example of the building ceiling or the building wall or the concrete ceiling or the concrete wall, of a heating/cooling requirement of the room therebelow, as well as of the desired storage performance.

A first pipe register can in particular be disposed in the profiled sections.

A second pipe register can in particular be disposed in the building element.

Heat from the profiled sections and/or from the building element can in each case be extracted or transferred thereto by way of the pipe registers.

An electric heater can be disposed in the building element ceiling. Said electric heater can be used for directly electrically heating the building element. Excess electricity which may arise in the intense producing of electricity by renewable energy sources can thus be used for heating the building element or the building ceiling, respectively, and the heat generated therein can be stored for times when said heat is required, for example.

The building element assembly furthermore preferably has a control installation for controlling the pipe registers and/or the electric heater. Different functional capabilities can thus be implemented, for example functional capabilities such as those which are described in more detail hereunder.

For example, the control installation in a hydraulic charging operation can be configured for heating the building element by means of the second pipe register. On account thereof, thermal energy can be stored in the building element for later use.

The control installation in an electric charging operation can be configured for heating the building element by means of the electric heater. Thermal energy can also be stored thereby, wherein electric heating is directly enabled.

The control installation in a backup heating operation can be configured for retrieving thermal energy from the building element by means of the second pipe register, and for thereby heating the profiled sections by means of the first pipe register. On account thereof, actively stored energy can be retrieved from the building element and delivered to the profiled sections which are heated on account thereof. The stored energy can be used for heating in this way.

The control installation in a hydraulic boosting heating operation can be configured for heating the profiled sections by means of the first pipe register, wherein the thermal energy required to this end is not obtained by means of the second pipe register. The thermal energy can emanate from an external heating installation, for example, which is configured as an electric heating, as a heat pump or as a heating installation which generates heat by combustion of energy resources, for example. A potential deficit in terms of thermal energy can be supplied on account thereof, for example because of insufficient thermal energy passing through the insulation assembly.

Electric heating wires can be configured in or on the profiled sections, and the control installation in an electric boosting heating operation can be configured for heating the profiled sections by means of the heating wires. Thermal energy required at the profiled sections can be directly electrically supplied on account thereof.

The control installation can be configured for determining a boosting heating requirement and as a function thereof for activating, for deactivating and/or for controlling a boosting heating operation. On account thereof, a certain degree of heating a room by way of thermal energy being directed through the insulation assembly, this always taking place and never being fully avoidable even in the case of good insulation, can be used for heating a room and, when that heating is insufficient, boosting heating can take place in a defined manner, for example.

For example, the control installation can be configured for determining a boosting heating requirement as a function of a room temperature below, above or beside the building element and/or as a function of a thermal flow through the insulation assembly. On account thereof, a boosting heating requirement can be determined in a targeted manner and boosting heating can be initiated, for example in order to bring a measured room temperature up to a predefined or adjustable nominal temperature.

The building element assembly can have a number of one or a plurality of suspension devices by means of which the profiled sections are suspended on the building element or the building ceiling, respectively. This enables a simple fastening of the profiled sections. The profiled sections herein can be suspended such, for example, that the insulation assembly is disposed between the profiled sections and the building element.

The building element assembly can also have a number of one or a plurality of spacers by means of which the profiled sections are fastened above or beside the building element so as to be spaced apart from the latter. This can be particularly advantageous when the profiled sections are used on a wall or in a floor.

The electric heater can be embodied as a heating layer, for example. Planar and uniform heating can be achieved on account thereof. However, other embodiments are also possible; for example, the electric heater can be embodied by heating wires or by block-shape heating elements.

A further insulation assembly can be configured above the building element and/or opposite the insulation assembly, for example thus also below the building element or beside the building element. This enables insulation toward the top, or in relation to another direction, respectively, such that a room situated above the building element assembly is not or only slightly heated by thermal energy that has been incorporated into the building element. Separate and independent temperature-controlling of this room can be enabled on account thereof.

The invention furthermore relates to the use of a building element assembly as described herein, wherein basic temperature-control is achieved by means of a thermal flow through the insulation assembly; and a desired room temperature is set by boosting heating.

In terms of the building element assembly, reference can be made to all embodiments and variants described herein. The boosting heating can in particular take place by way of the profiled sections.

Basic temperature-control can be achieved in a simple manner by the described use, wherein the building element can be charged with heat when the latter is favorably available, for example. The desired temperature in the room can nevertheless be set by the boosting heating.

The boosting heating can in particular take place by means of a pipe register which runs through the profiled sections. Said boosting heating can also take place by means of a heating wire which is fastened to the profiled sections. To this end, reference can be made to the embodiments already described above, for example.

The invention is schematically illustrated in particular in one exemplary embodiment in the drawing in which.

Figures 5A, 5B:
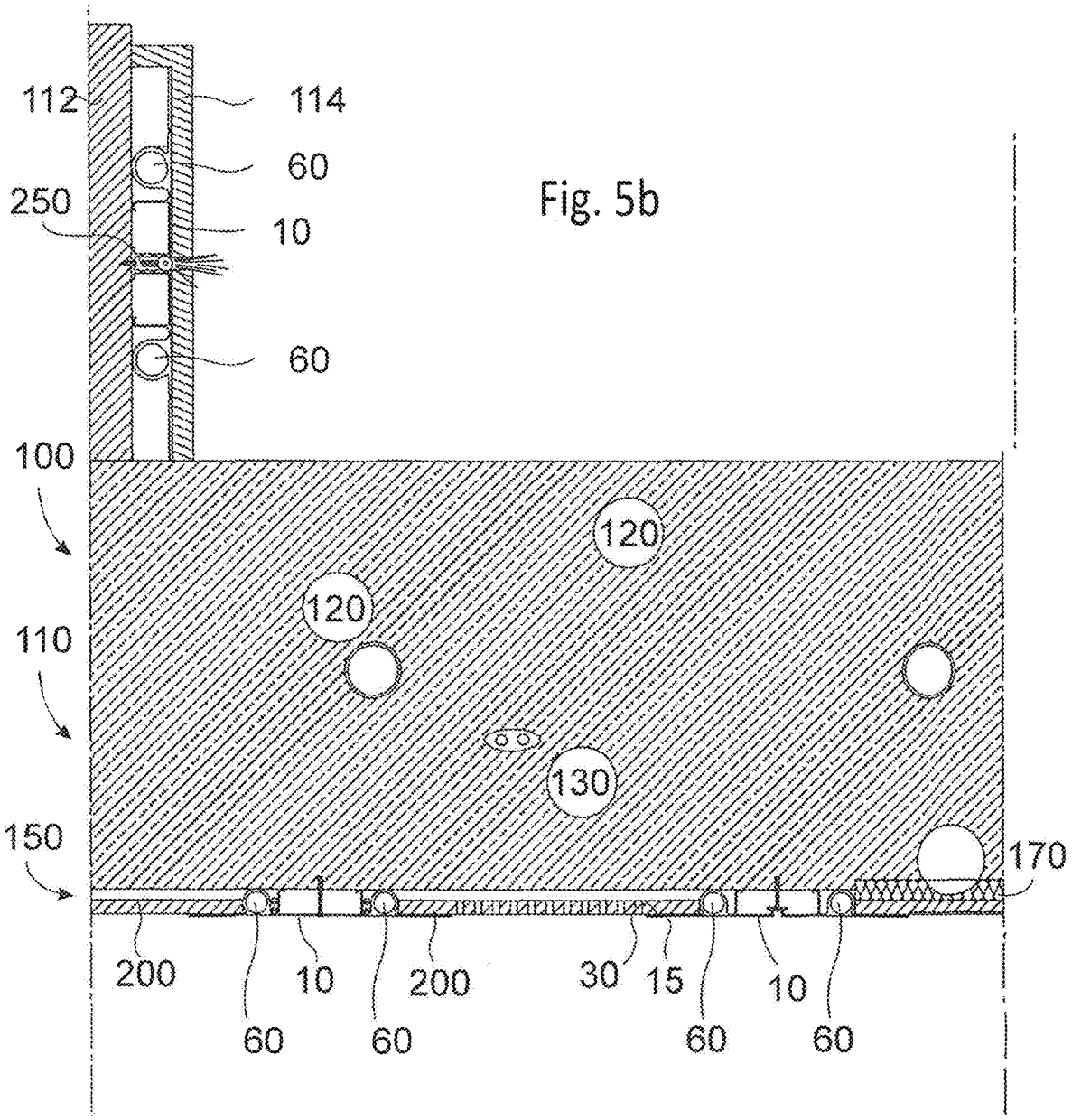
Figures 6A, 6B:
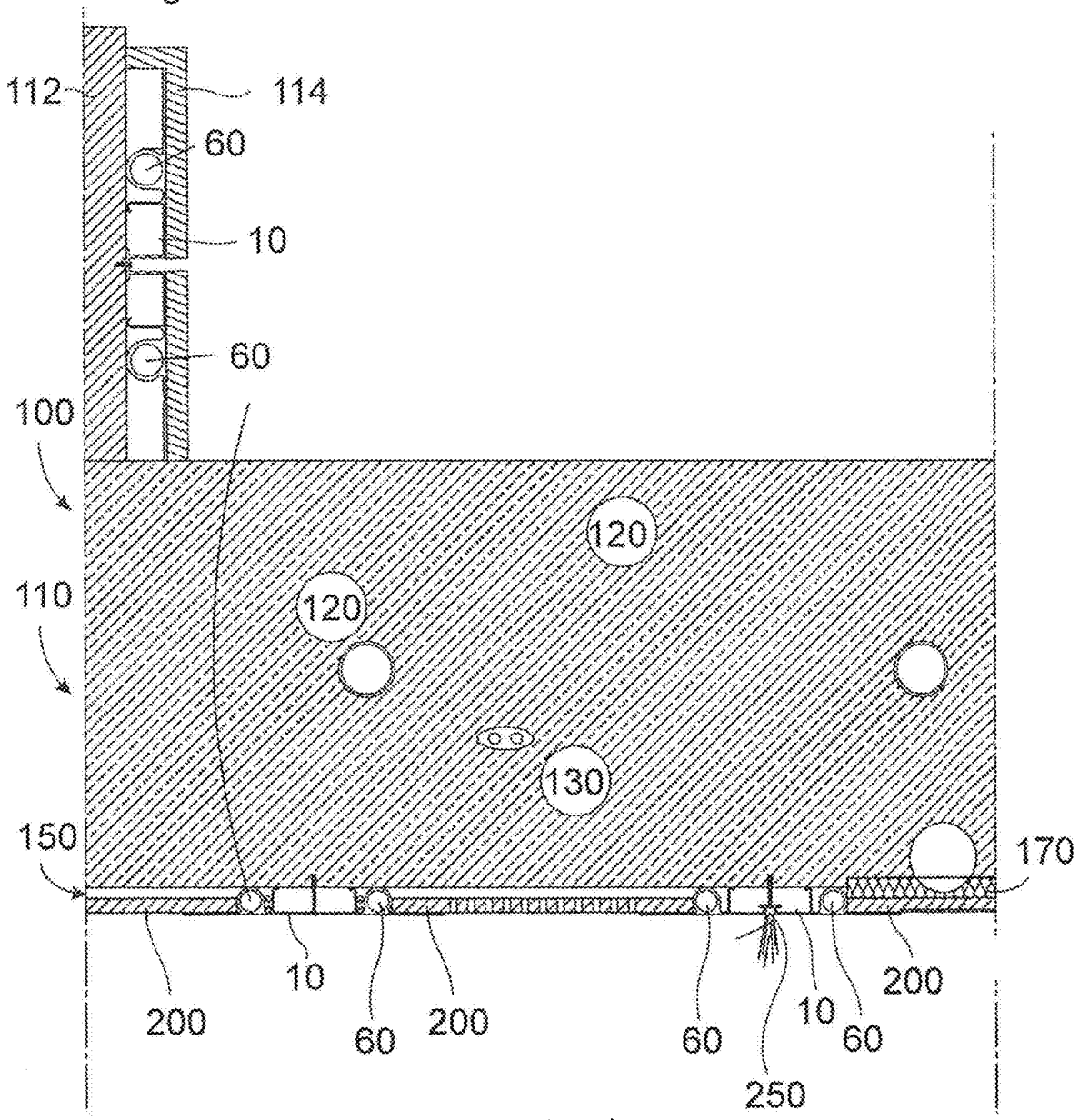
Figure 7:
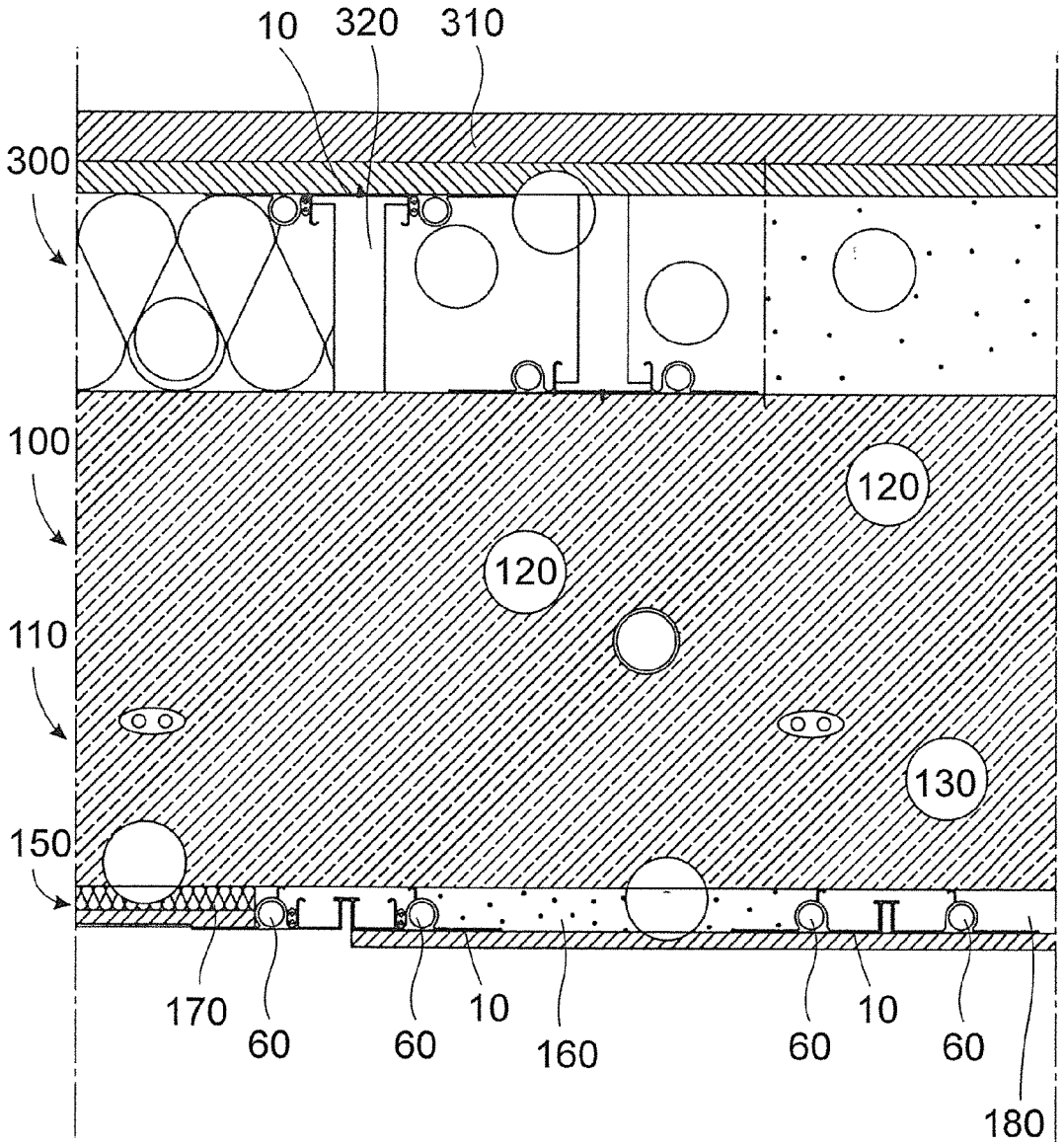
Figure 8:
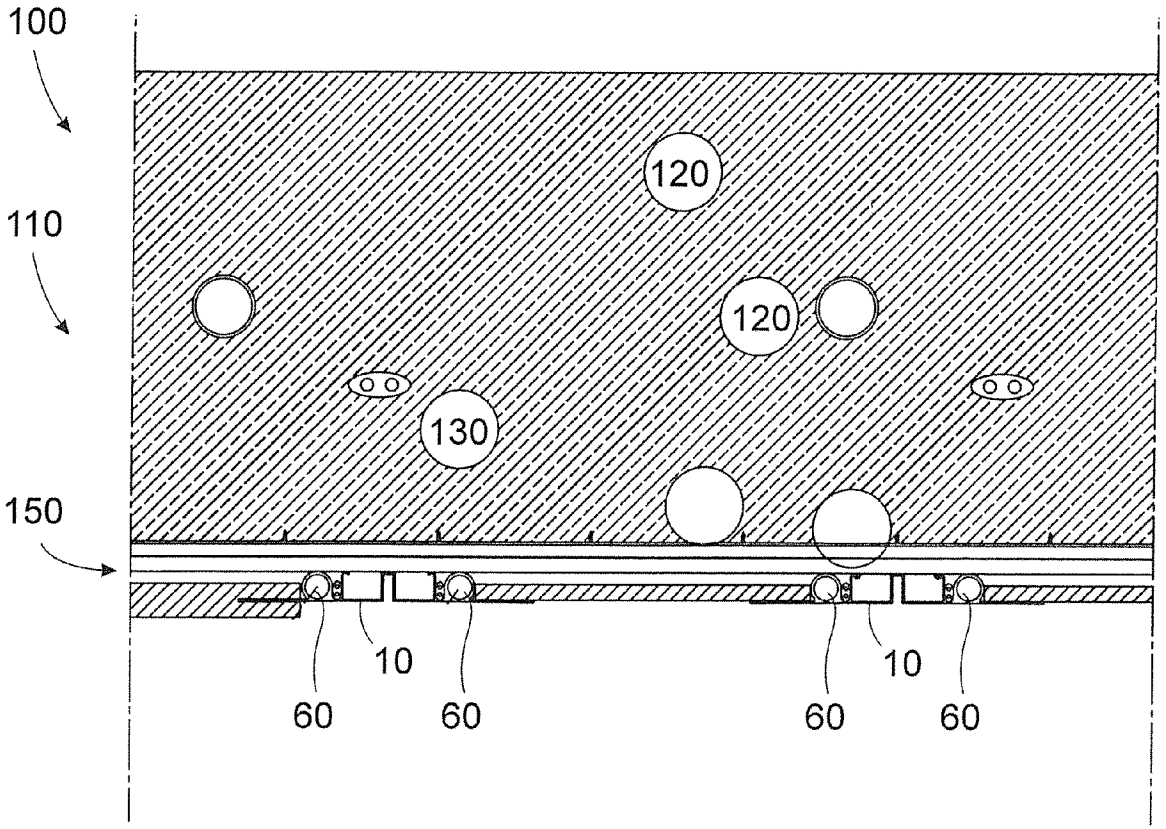
Figure 11:
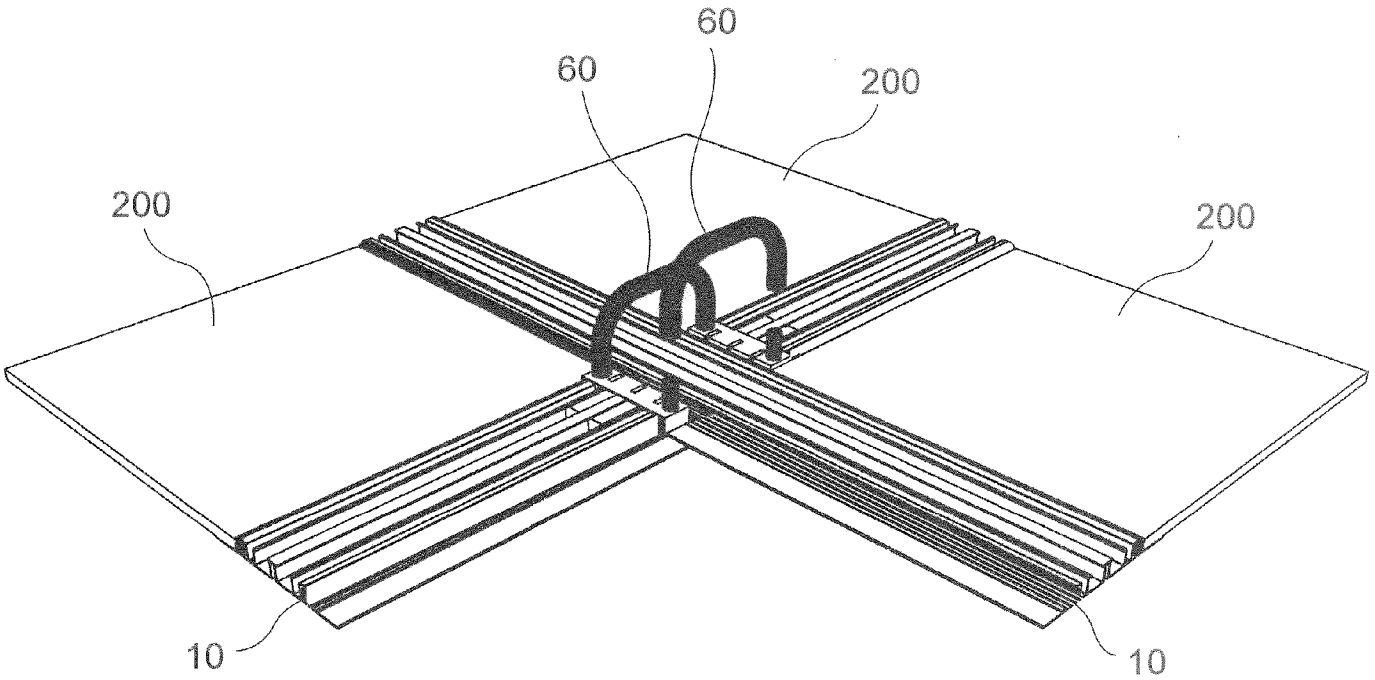

FIGS. 5*a* and 5*b* show a building element assembly;

FIGS. 6*a* and 6*b* show a building element assembly;

FIG. 7 shows a building element assembly;

FIG. 8 shows a building element assembly;

FIGS. 9*a*-9*d* show a profiled section;

FIGS. 10*a*-10*d* show a profiled section;

FIG. 11 shows an installed situation of part of a building element assembly

Figure 13:
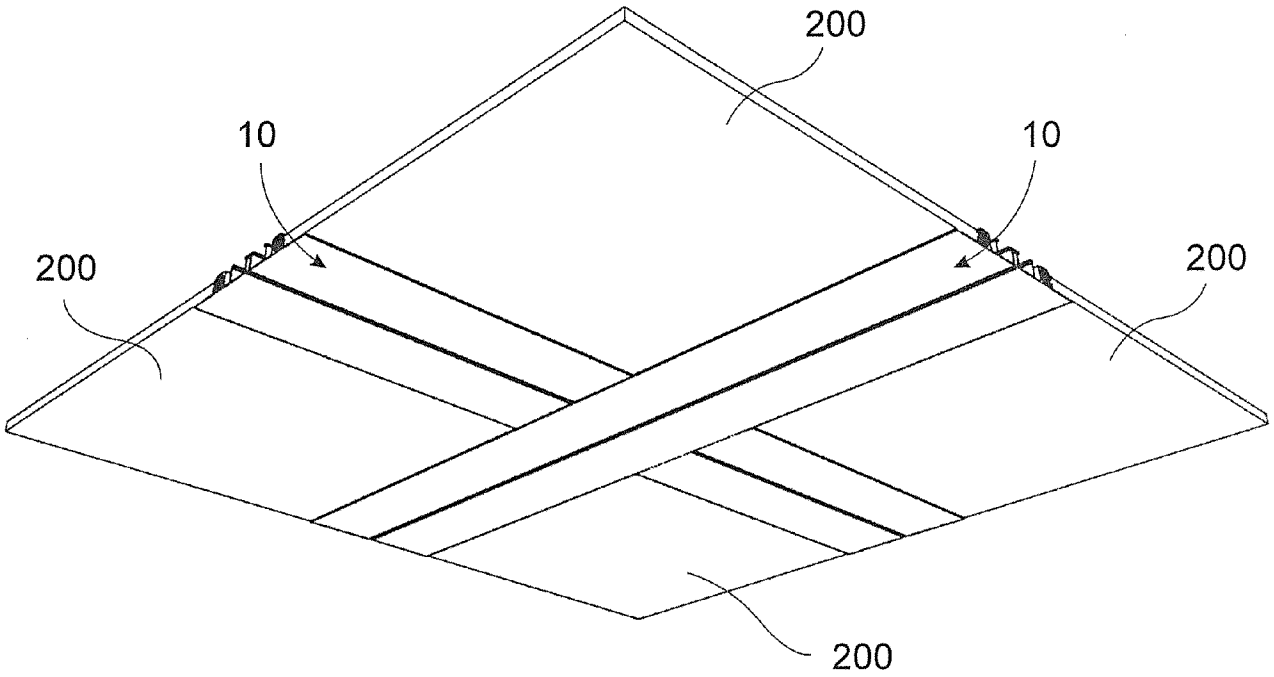
Figures 14A, 14B, 14C, 14D:
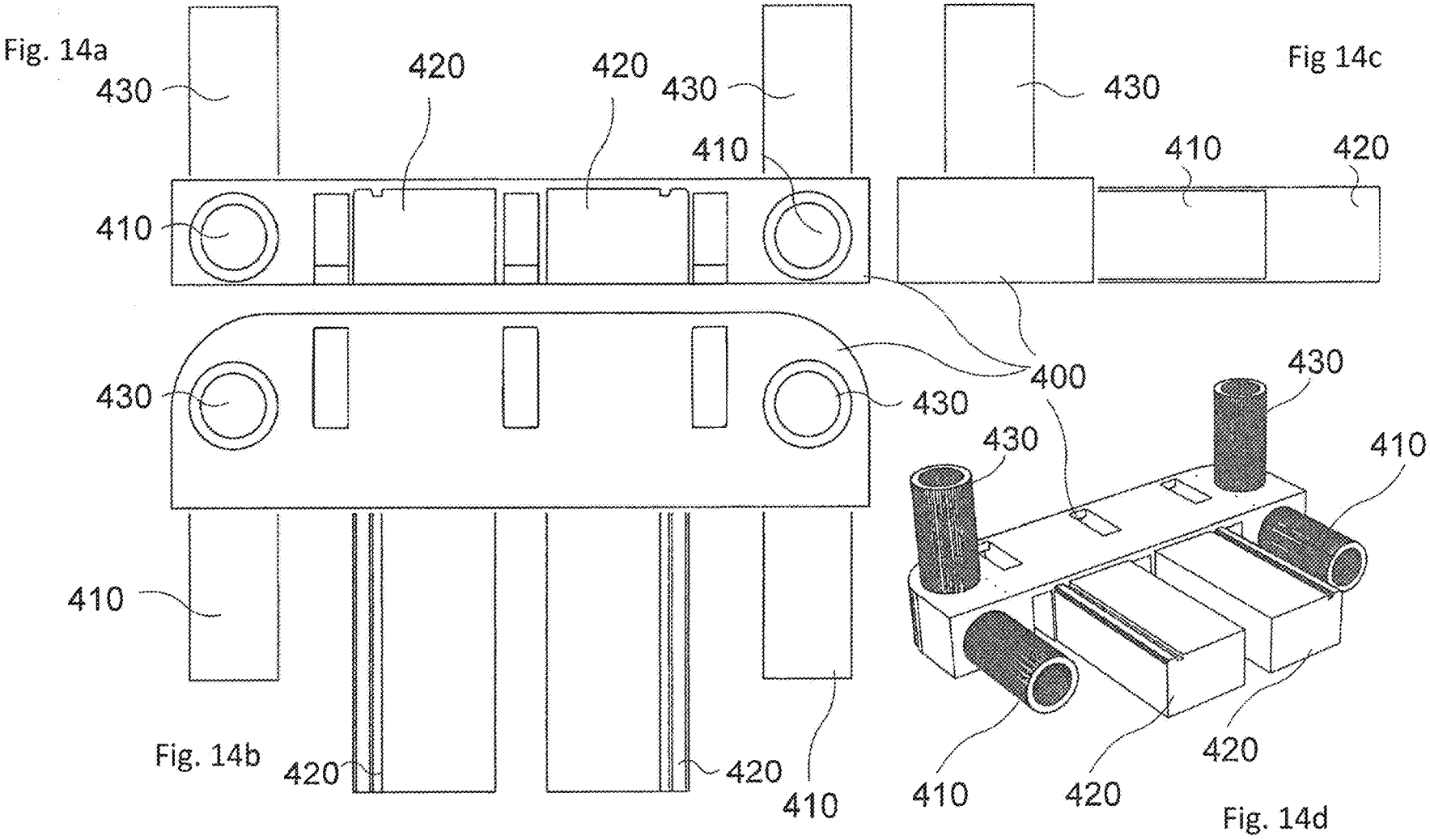
Figure 15:
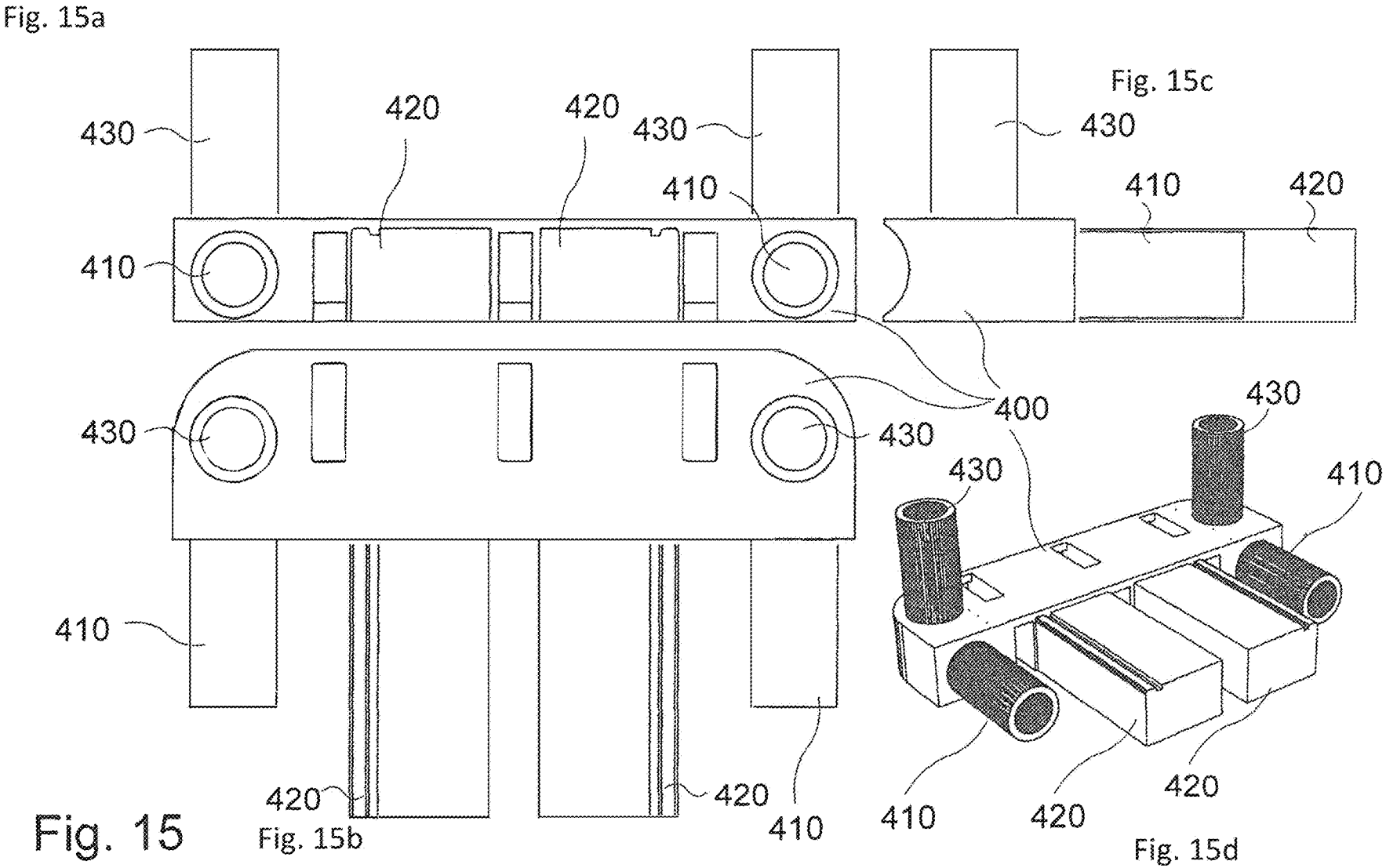
Figure 16:
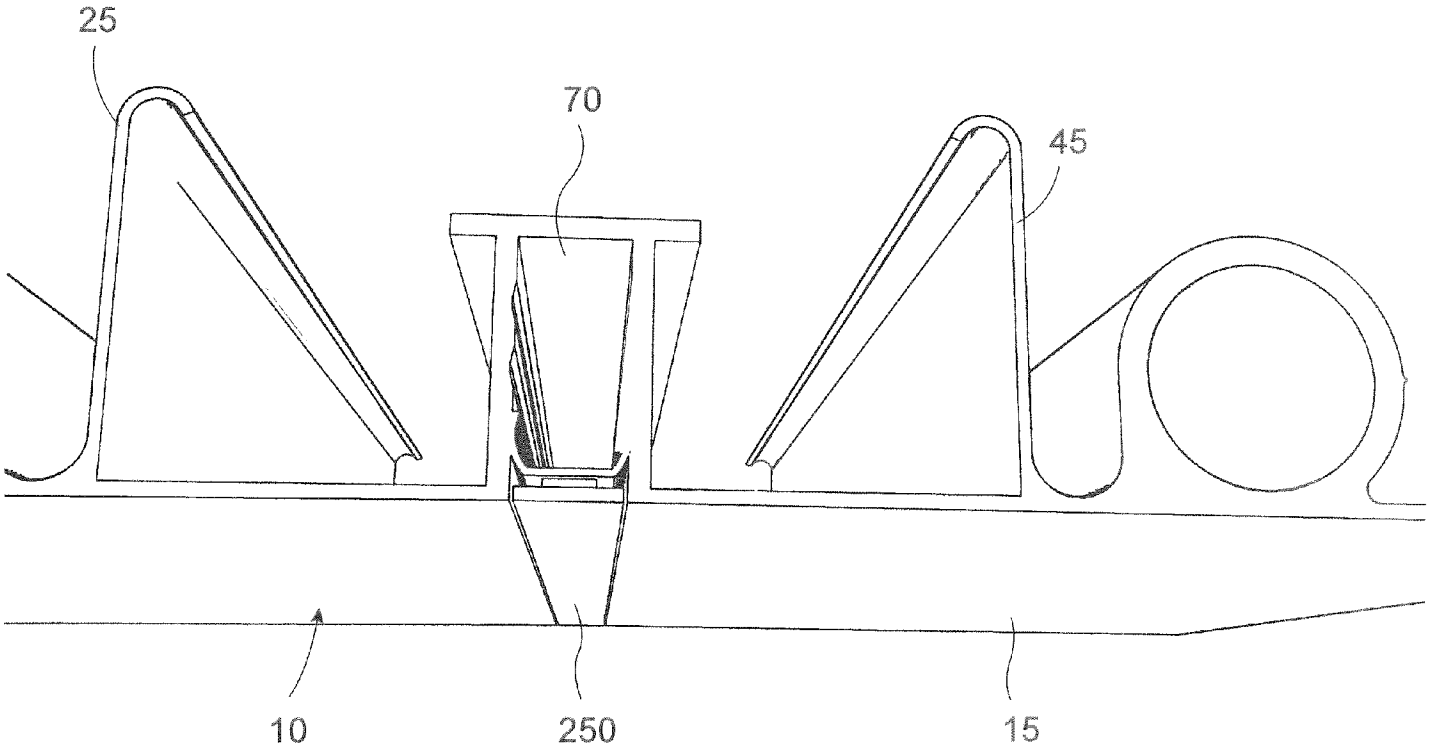

FIGS. 12*a*-12*d* show a profiled section;

FIG. 13 shows an installed situation of part of a building element assembly;

FIGS. 14*a*-14*d* show a connector;

FIGS. 15*a*-15*d* show a connector;

FIG. 16 shows part of the profiled section; and

Figure 17:
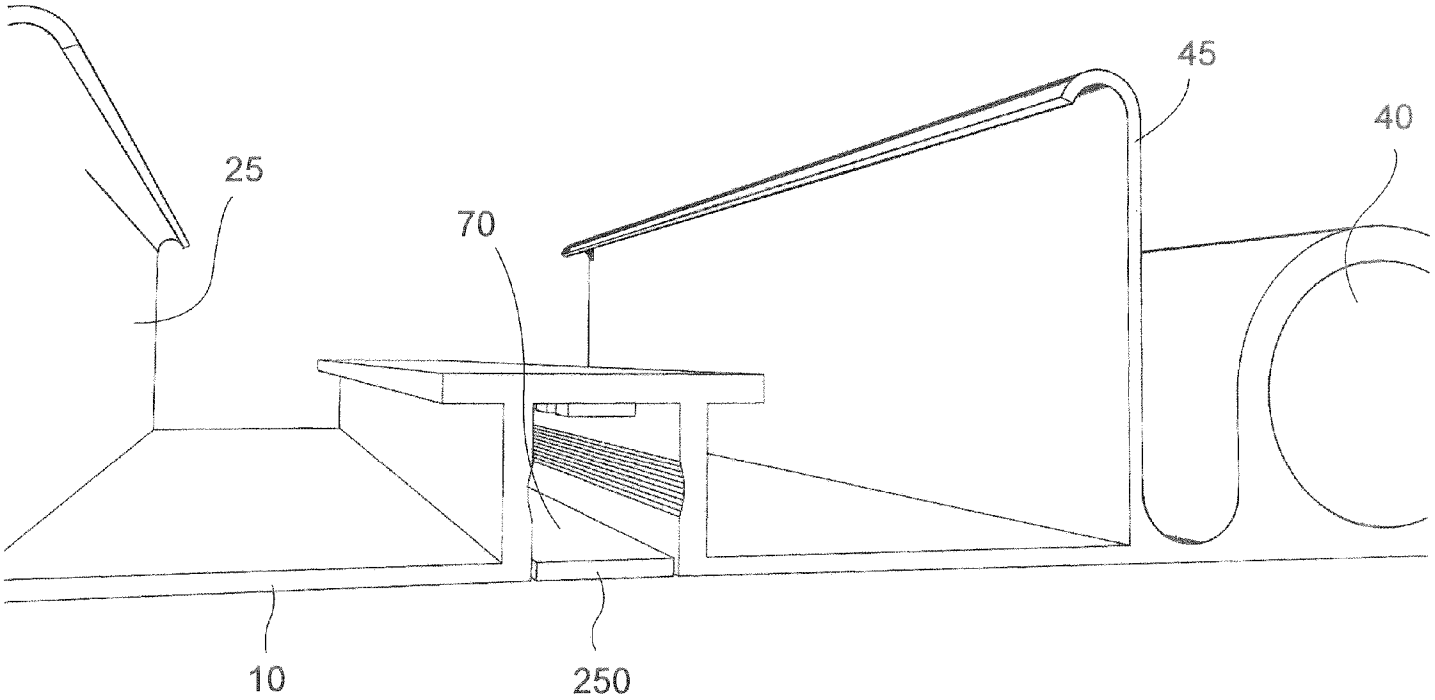

FIG. 17 shows part of the profiled section.

In the figures, identical or mutually corresponding elements are each denoted by the same reference signs and are therefore not described again, unless expedient. The disclosures contained in the entire description are expediently transferrable to identical parts with the same reference signs or the same component designations. The positional details selected in the description, e.g. top, bottom, laterally, etc. are also related to the directly described and illustrated figure and can expediently be transferred in the event of a change in position to the new position. Furthermore, individual features or combinations of features from the different exemplary embodiments shown and described can also be independent, inventive solutions or solutions according to the invention.

Figure 1:
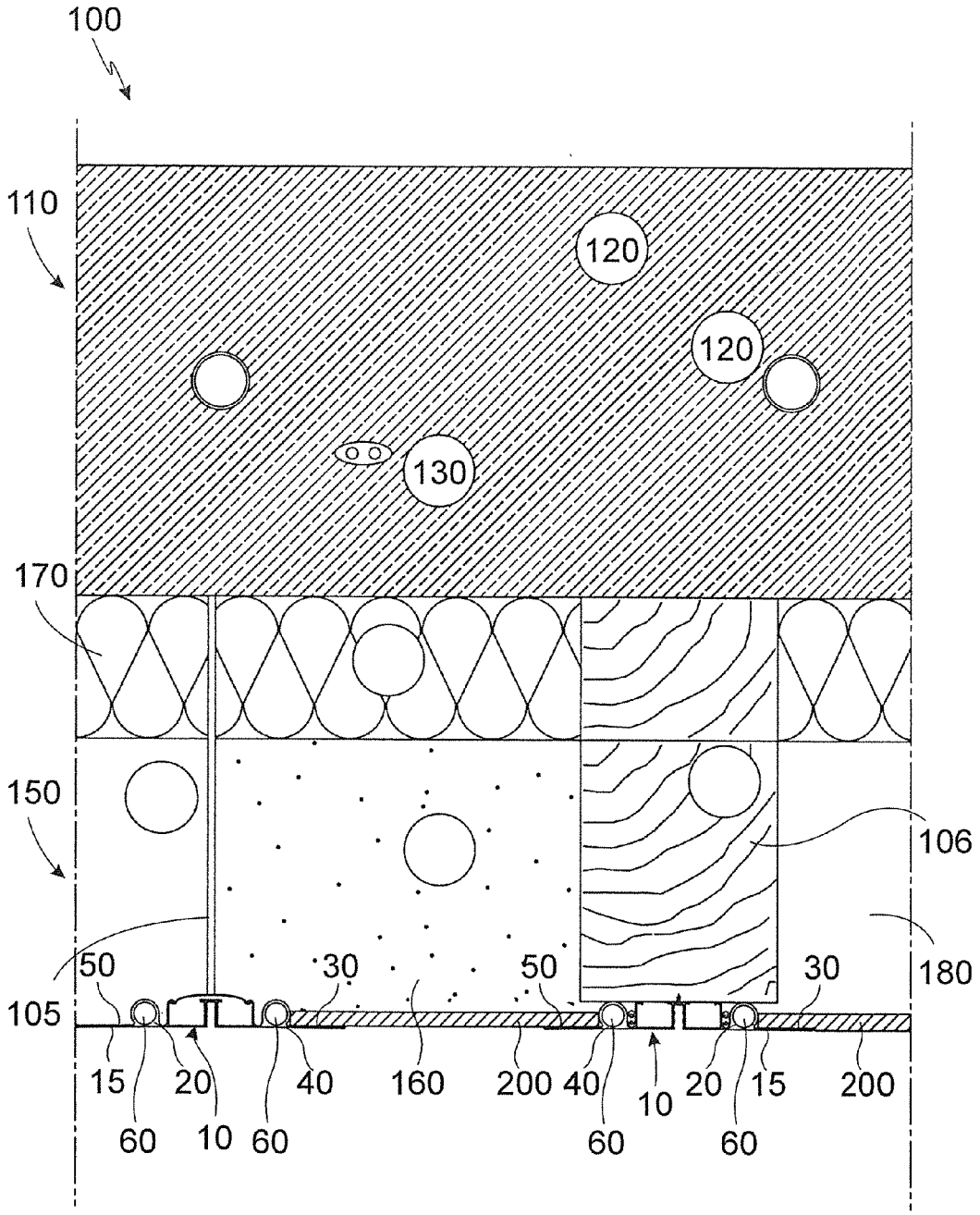
FIG. 1 shows a building element assembly.

FIG. 1 shows a building element assembly 100 according to a first exemplary embodiment of the invention. Said building element assembly 100 contains two profiled sections 10 according to one exemplary embodiment of the invention.

The building element assembly 100 has a building ceiling 110 which presently represents a building element. This can thus also be referred to as the ceiling assembly. The building ceiling 110 is disposed at the top and is typically a component part of a building not illustrated in more detail. The building ceiling 110 can be configured from concrete, for example. The use of other materials is however also possible.

An insulation assembly 150 is disposed directly below the building ceiling 110. Said insulation assembly 150 is formed from different components which will be described hereunder. Other exemplary embodiments of the building element assembly 100 may in particular also have other embodiments of an insulation assembly.

As already mentioned, the building element assembly 100 has two profiled sections 10. The latter are only schematically illustrated here, and not all features of these profiled sections will be discussed here. It is also to be mentioned that the profiled sections 10 here are illustrated only in an exemplary manner and a typical building element assembly will often have more than two profiled sections 10.

The profiled sections 10 are fastened to a first suspension device 105 and to a second suspension device 106. The suspension devices 105, 106 herein are in each case fastened to the building ceiling 110 and thus ensure a defined spacing of the profiled sections 10 in relation to the building ceiling 110. The suspension devices 105, 106 herein penetrate the insulation assembly 150 which is situated between the profiled sections 10 and the building ceiling 110. In the embodiment shown, the first suspension device 105 is embodied as a bar, and the second suspension device 106 is embodied as a beam.

A second pipe register 120 is disposed in the building ceiling 110. Said second pipe register 120 is configured in the form of hydraulic ducts which are only schematically illustrated here.

An electric heater 130 is likewise configured in the building ceiling 110. Said electric heater 130 is only schematically illustrated and can in particular be configured in the form of electrical resistance heaters.

The insulation assembly 150 has a plurality of components which ensure that building ceiling 110 is thermally insulated in relation to the profiled sections 10. A filling which has an insulating effect is provided directly above the profiled sections 10 and between the suspension devices 105, 106. An air space 180 which likewise has an insulating effect is provided to the right of said filling in FIG. 1. An insulation material 170 which may be configured from expanded polystyrene, for example, is disposed above the filling 160, or the air space 180, respectively.

The profiled sections 10 have respective receptacles 20 for a first pipe register 60. The first pipe register 60 runs through the profiled sections 10 and serves for hydraulically temperature-controlling the profiled sections 10. The functional capability will be discussed in more detail hereunder.

The profiled sections 10 on the lower side have respective end faces 15. End plates 200 which bear on contact faces 30, 50 of the profiled sections 10 are disposed between the profiled sections 10. The end faces 15 and the end plates 200 conjointly form a downward-pointing visible face which can be seen from a room situated below the building element assembly 100.

Various functional capabilities which will be described in an exemplary manner hereunder are possible on account of the embodiment shown.

The building ceiling 110 can be heated by means of the second pipe register 120. To this end, heated fluid can be pumped through the first pipe register 60. The fluid can be heated, for example, by means of a heating which is based on the combustion of fuels, or by a heat pump or an electric heating, for example.

The electric heater 130 can furthermore be used for heating the building ceiling 110. An electric current can be directly used to this end. This possibility for heating can be used when favorable or excess electricity is available, for example.

On account of the insulation assembly 150, the heat that is incorporated in the building ceiling 110 can be retained therein over a comparatively long period. A certain degree of thermal transmission through the insulation assembly 150 does indeed take place even in the case of very good insulation, but said thermal transmission can be adapted to the specific conditions, for example by calculation.

The profiled sections 10 can be heated in a targeted manner and independently of the building ceiling 110 by means of the first pipe register 60. The latter can in particular be used when thermal energy is not to be stored but is to be directly effective for heating the room.

On account of the embodiment shown, an operation can in particular be implemented in such a manner that thermal energy is incorporated into the building ceiling 110 and is stored therein over a comparatively long period, wherein ongoing basic heating of a room situated below the building element assembly 100 is achieved by way of the thermal transmission that is always present through the insulation assembly 150.

The temperature of the room can be measured, for example. When the temperature is below a nominal value, the heating can be boosted in a targeted manner by means of the first pipe register 60 so as to achieve the nominal value.

The energy required for heating the profiled sections by means of the first pipe register 60 can be externally generated, for example by means of a heating based on the combustion of fuels, by means of a heat pump, or by means of an electric heating. However, the energy can also be retrieved from the building ceiling 110 by means of the second pipe register 120, for example. To this end, fluid can be pumped through the second pipe register 120, said fluid initially being even cooler than the building ceiling 110. The fluid is heated herein. The correspondingly heated fluid can then be directed through the first pipe register 60 so as to heat the profiled sections 10.

It is to be mentioned that the first pipe register 60 can in particular also be used for cooling the profiled sections 10. Cooling of a room can be achieved herein, for example. The thermal energy which is discharged by an illumination means which is installed in the respective profiled section 10 can also be discharged, for example. Corresponding illumination means will be discussed in more detail hereunder.

Figure 2:
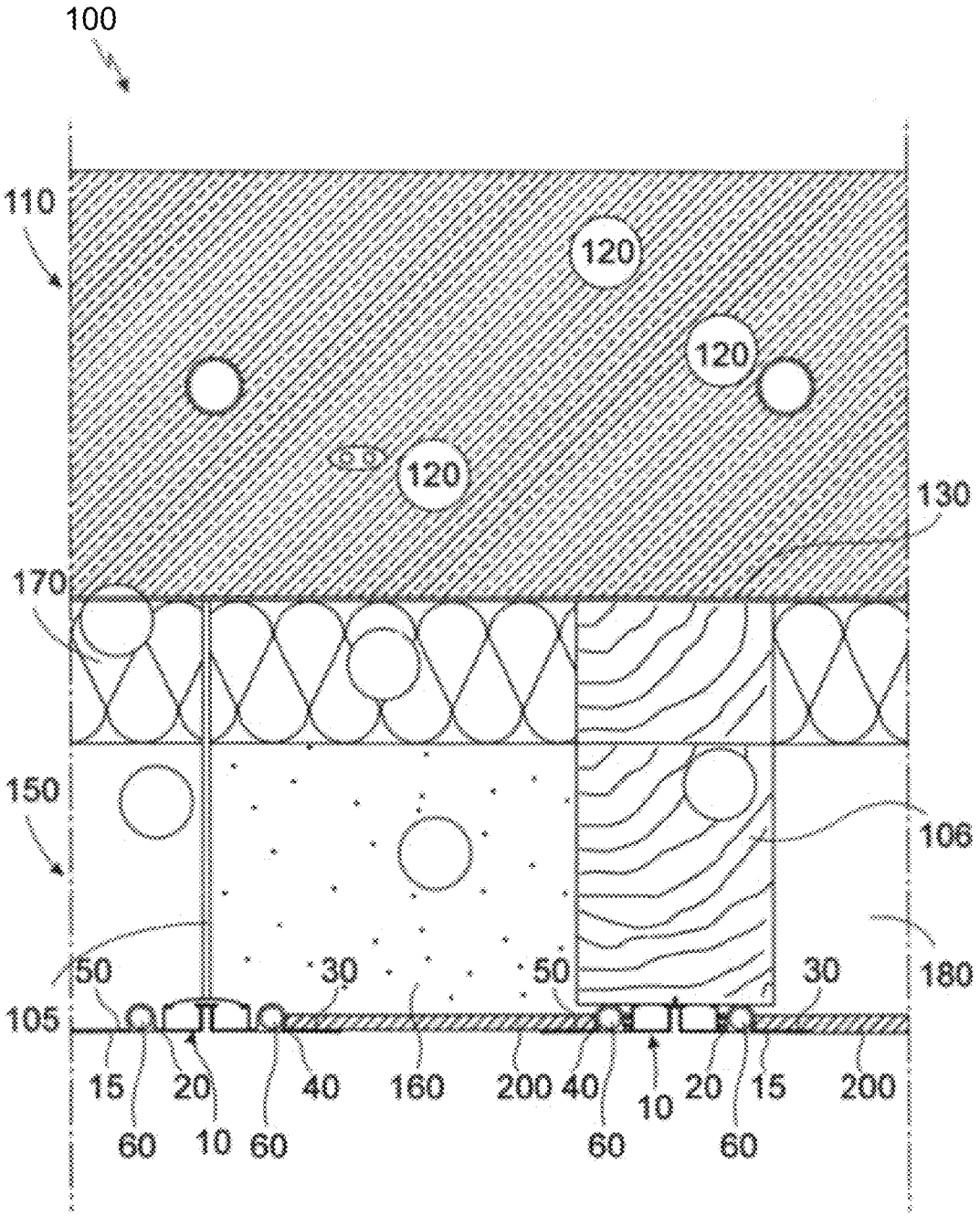
FIG. 2 shows a building element assembly.

FIG. 2 shows a building element assembly 100 according to a second exemplary embodiment. As opposed to the first exemplary embodiment, the building element assembly 10 according to the second exemplary embodiment has a planar electric heater 130 directly below the building ceiling 110. This permits electric heating in a planar manner.

Figure 3:
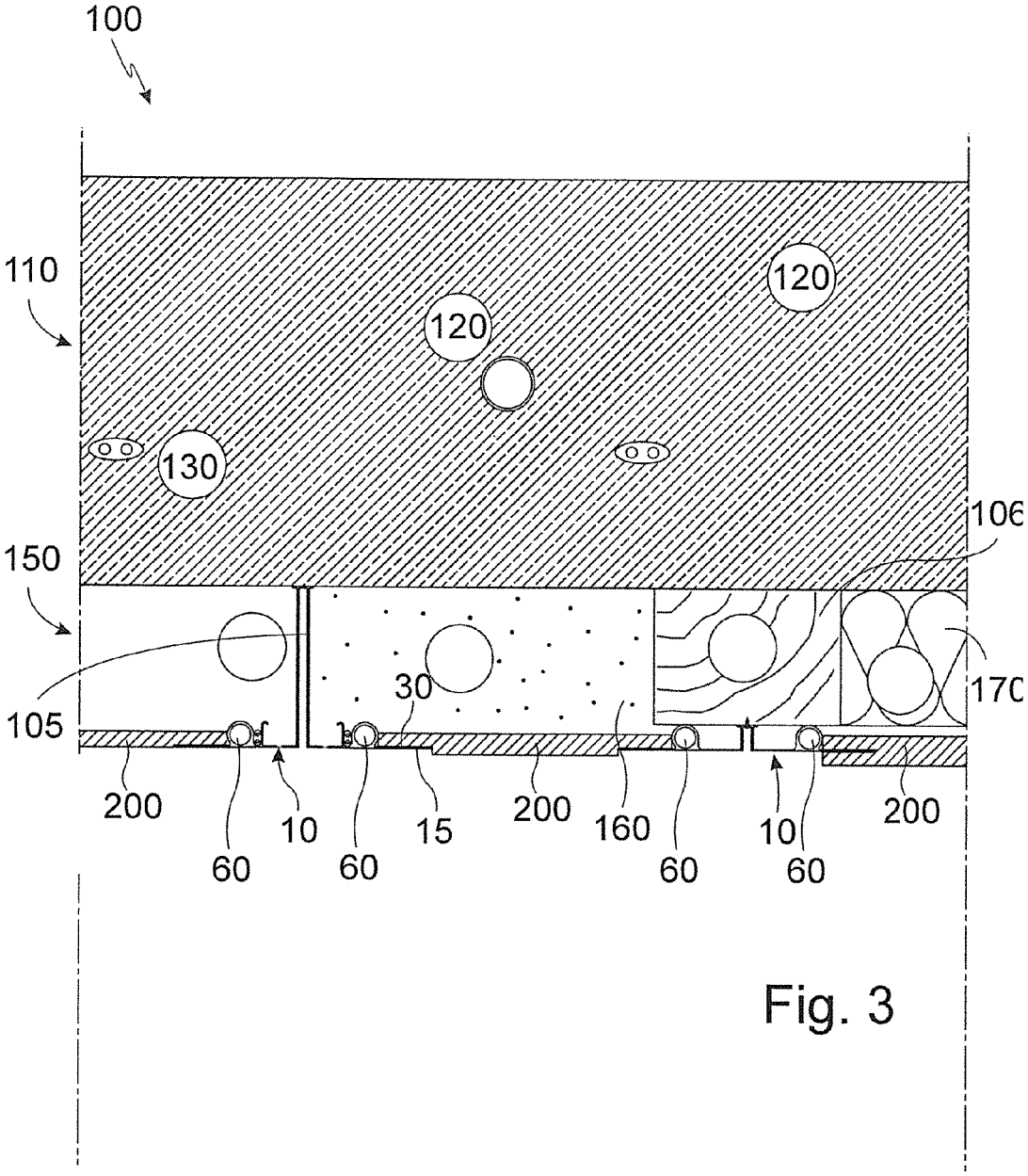
FIG. 3 shows a building element assembly.

FIG. 3 shows a building element assembly 100 according to a third exemplary embodiment. As opposed to the first and the second exemplary embodiments the insulation assembly 150 here in is embodied so as to be thinner. Said insulation assembly 150 has a filling 160 and an insulation material 170 at the same height.

Figure 4:
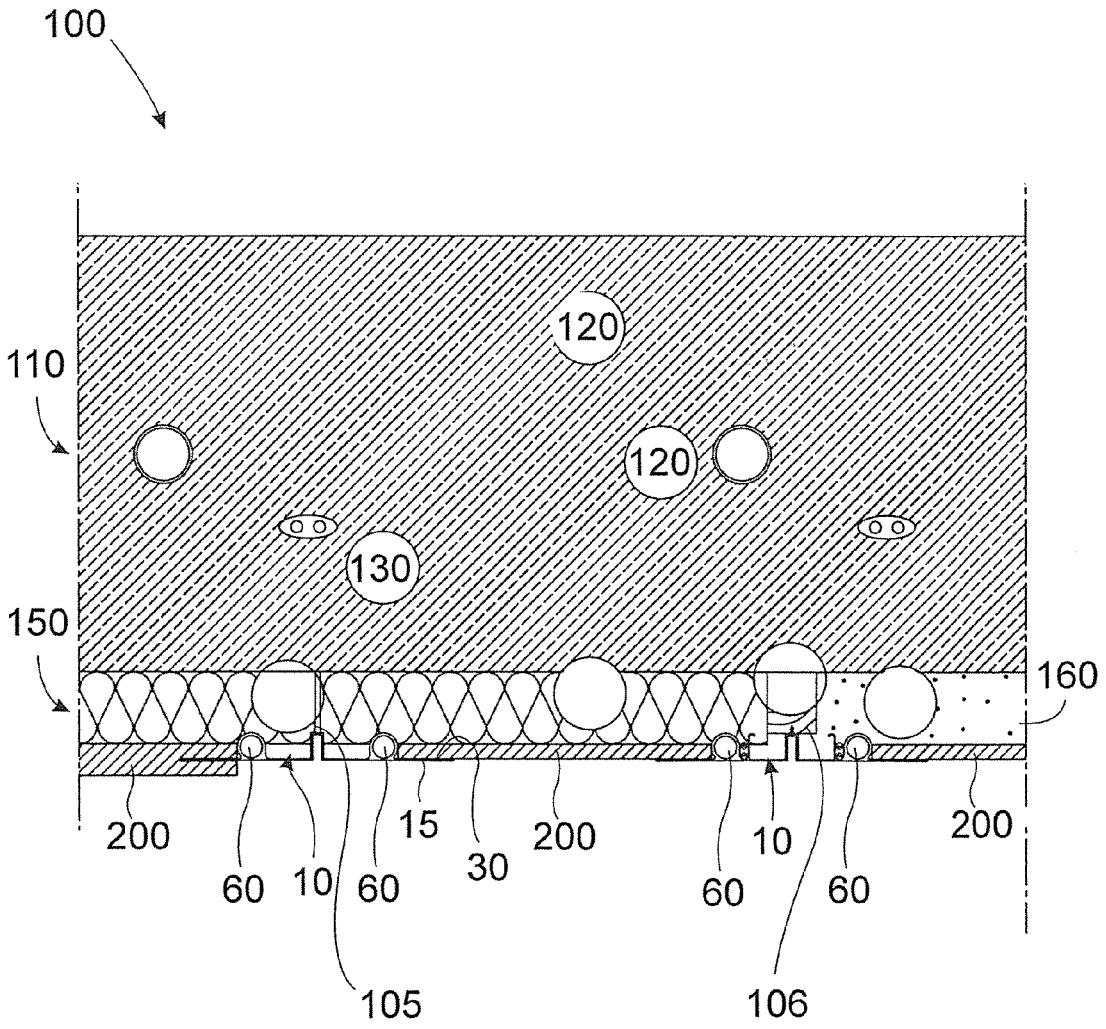
FIG. 4 shows a building element assembly.

FIG. 4 shows a building element assembly 100 according to a fourth exemplary embodiment. The insulation assembly 150 herein is also again different and embodied so as to be yet again thinner. Said insulation assembly 150 is formed by an insulation material 170 and a filling 160.

FIG. 5*a* shows a building element assembly 100 according to a fifth exemplary embodiment. The insulation assembly herein by means of an insulation material 170 is configured only in part of the area. Otherwise, the profiled sections 10 are directly adjacent to the building ceiling 110. An improved thermal transmission to the profiled sections 10 is achieved on account thereof, said thermal transmission being able to be used for heating, for example.

FIG. 5*b* shows an embodiment of a profiled section having an integrated illumination means 250, wherein the profiled section 10 is presently attached to a wall 112. Such a use is likewise possible. The profiled section 10 herein is rotated by 90° in comparison to the other profiled sections 10. Moreover, said profiled section 10 is covered by a cover plate 114, only the illumination means 250 being able to shine through said cover plate 114. Said illumination means 250 can be used for illuminating a room. In principle, such an embodiment can be used in combination with all building element assemblies 100 shown here or other building element assemblies 100.

FIG. 6*a* shows a building element assembly 100 according to a sixth exemplary embodiment. An integrated illumination means 250 is shown herein. FIG. 6*b* shows an embodiment on a wall 112 which corresponds to the embodiment of FIG. 5*b*, but without an integrated illumination means.

FIG. 7 shows a building element assembly 100 according to a seventh exemplary embodiment. As opposed to the previous embodiments, a further insulation assembly 300 is disposed above the building ceiling 110 herein. This permits an insulation not only toward the bottom but also toward the top, for example in relation to a room of a building that is disposed above the building ceiling 110. This room can be temperature-controlled independently, for example, or so as to only partially depend on the building element assembly 100. In principle, such a further insulation assembly 300 can be combined with all other embodiments described herein. In terms of the potential embodiments of the further insulation assembly 300, reference can be made to the potential embodiments of the insulation assembly 150, for example. For example, the further insulation assembly 300 can also be formed from a filling, an insulation assembly and/or an air space.

A floor 310 is disposed above the further insulation assembly 300. A profiled section 10 which by means of a spacer 320 is fastened above the building ceiling 110 is also disposed on this floor 310. Such a profiled section is thus in principle also suitable for temperature-controlling a floor.

FIG. 8 shows a building element assembly 100 according to an eighth exemplary embodiment. The insulation assembly 150 herein is configured so as to be only very thin.

Figures 9A, 9B, 9C, 9D:
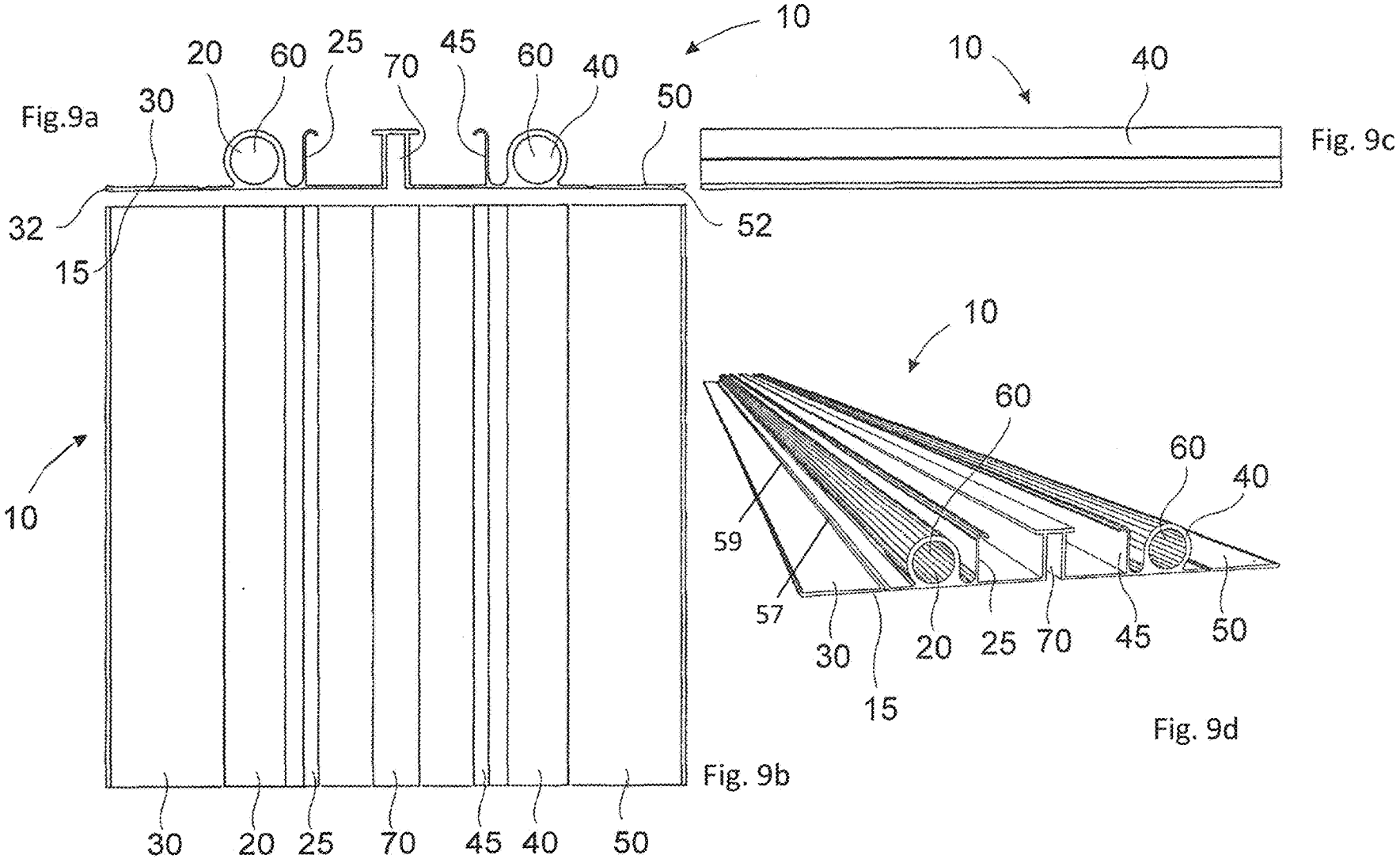

FIGS. 9*a*-9*d* separately show a profiled section 10 according to a first exemplary embodiment. FIG. 9*a* herein shows a lateral view, FIG. 9*b* shows a plan view, FIG. 9*c* shows a further lateral view, and FIG. 9*d* shows a perspective view. It is to be understood that the profiled sections described herein can in principle be combined with the building element assemblies described.

The profiled section 10 has the end face 15 which has already been described and in a typical installed state points downward. The profiled section 10 has a receptacle 20 and a further receptacle 40. A pipe register 60 which in the installed state already described forms the first pipe register is disposed in the receptacles 20, 40.

A first contact face 30 and a second contact face 50 are disposed so as to be lateral to the receptacles 20, 40. The end plates 200 bear on said contact faces 30, 50 in the installed state already described. Planar portions 32, 52 are configured between the contact faces 30, 50 and the end face 15.

A first retaining web 25 and a second retaining web 45 are disposed on the upper side on the profiled section. Said retaining webs 25, 45 are presently configured so as to be hook-shaped. The profiled section 10 can thus be fastened to elements disposed further above, for example be hooked into said elements.

The profiled section 10 furthermore has a groove 70 which is open toward the bottom. An illumination means, for example an LED illumination means, can be received in this groove 70, as has already been described in an exemplary manner.

The profiled section 10 can in particular be used as has already been described. Said profiled section 10 can be installed in the context of a building element assembly 100. In particular, a plurality of such profiled sections 10 can be used herein.

Figures 10A, 10B, 10C, 10D:
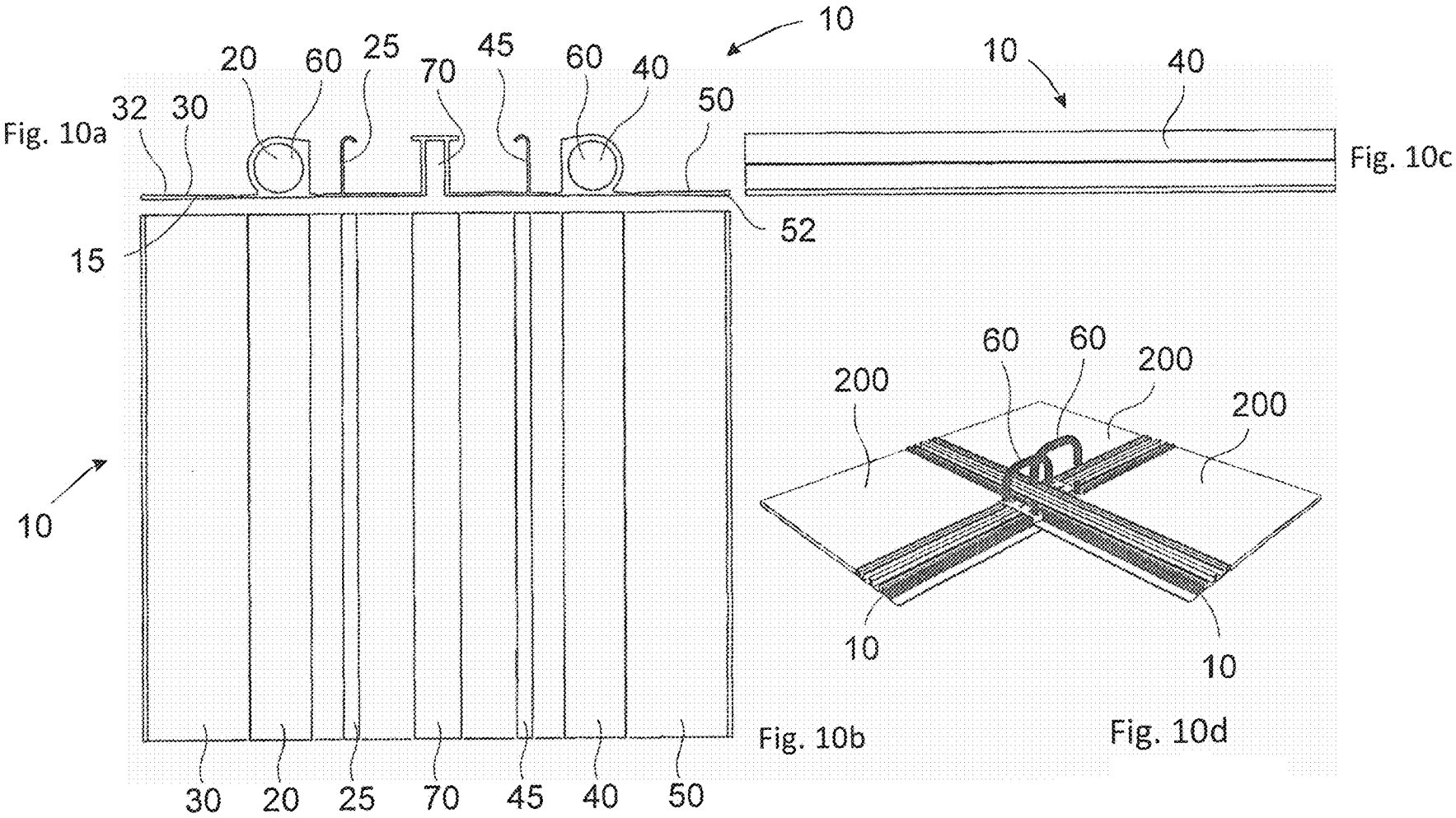

FIGS. 10*a*-10*c* show a profiled section 10 according to a second exemplary embodiment. The profiled section 10 is in principle constructed so as to be similar to the profiled section illustrated in FIGS. 9*a* and 9*b*. However, the peripheries of the receptacles 20, 40 which in each case point toward the right or toward the left, respectively, are embodied so as to be flat.

FIG. 10*d* shows an installed situation having two profiled sections 10 and connecting end plates 200. The latter are placed onto the profiled sections 10. It can also be seen herein that the pipe register 60 also has components outside the profiled sections 10. These components connect the parts of the pipe register which are disposed within the profiled sections 10.

FIG. 11 shows the installed situation of FIG. 10*d* in an enlarged illustration.

Figures 12A, 12B, 12C, 12D:
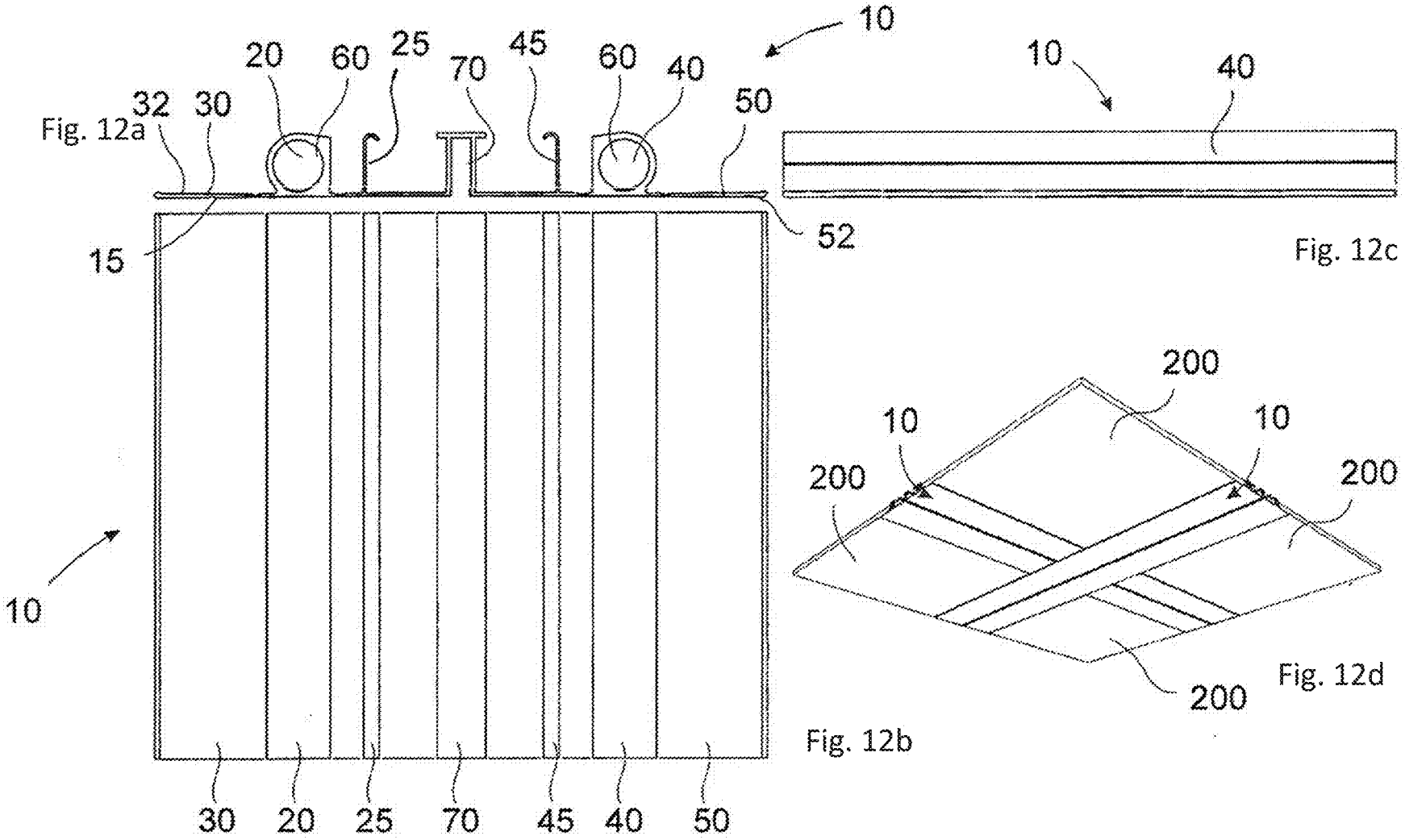

FIGS. 12*a*-12*c* show a profiled section 10 according to a third exemplary embodiment. Deviations from the previous exemplary embodiments can be seen by means of the figure. FIG. 12*d* shows a view from below onto an installed situation having two profiled sections 10 of this type and four end plates 200. FIG. 13 shows the installed situation of FIG. 12*d* in an enlarged view.

FIGS. 14*a*-14*d* show a connector 400 for fluidically connecting two profiled sections or other components in different views. The connector 400 has two profiled section connections 410 which can be introduced into the first pipe register 60 of a profiled section 10. Said connector 400 also has two retaining elements 420 which can be introduced between the groove 70 and the retaining webs 25, 45. Said connector 400 moreover has two connections 430 for connecting to other hydraulic components. The profiled sections 10 can thus be fastened and hydraulically connected by means of the connector 400. FIGS. 15*a*-15*d* show another embodiment of the connector, wherein a partially radiused rear side which enables a closer disposal in relation to a pipe, for example, is configured.

FIG. 16 shows a view of part of a profiled section 10. An illumination means 250 is received in the groove 70 herein. Said illumination means 250 faces downward such that said illumination means 250 when activated can illuminate a room disposed below the profiled section 10. FIG. 17 shows the profiled section 10 having the illumination means 250 from another perspective. It is to be mentioned in particular that the illumination means 250 can also be cooled by means of the pipe register. This can extend the service life of the illumination means 250.

Potential features of the proposal are reproduced in structured form below. The features reproduced in structured form below can be combined with one another as desired and can be incorporated in any combination into the claims of the application. It is clear to a person skilled in the art that the invention already arises from the subject matter having the fewest features. In particular, advantageous or possible refinements, but not the only potential refinements of the invention, are reproduced below.

The invention comprises:

A profiled section (10) for temperature-controlling a room; having

- a receptacle (20) for a pipe register (60);
- an end face (15) which is configured so as to be at least lateral to the receptacle (20); and
- at least one first contact face (30) for an end plate (200), wherein the first contact face (30) is configured so as to be lateral to the receptacle (20) and points in a direction counter to that of the end face (15).

The afore-mentioned profiled section,

- said profiled section furthermore having a second contact face (50) for a further end plate (200);
- wherein the second contact face (50) in terms of the receptacle (20) is disposed opposite the first contact face (30) and has a direction that is counter to that of the end face (15).

The afore-mentioned profiled section,
wherein the profiled section (10) is configured as an extruded profiled section, a rolled profiled section, or a folded profiled section.
The afore-mentioned profiled section,
wherein only one respective planar portion (32, 52) is configured between each contact face (30, 50) and the end face (15).
The afore-mentioned profiled section,
wherein the receptacle (20) has an opening toward the end face (15).
The afore-mentioned profiled section,
wherein the opening of the receptacle (20) has a cover.
The afore-mentioned profiled section,
wherein a pipe register (60) is disposed in the receptacle (20).
The afore-mentioned profiled section,
wherein the pipe register (60) is disposed so as to be longitudinally flush with the profiled section.
The afore-mentioned profiled section,
wherein the pipe register (60) is disposed so as to protrude beyond the pipe register.
The afore-mentioned profiled section,
wherein the pipe register (60) is fixedly configured in the receptacle (20).
The afore-mentioned profiled section,
wherein the profiled section (10) furthermore has a further receptacle (40) for a pipe register (60).
The afore-mentioned profiled section,
wherein the further receptacle (40) in terms of shape is configured so as to be identical or mirror-inverted to the receptacle (20).
The afore-mentioned profiled section,
wherein the profiled section (10) furthermore has a mounting for a heating wire.
The afore-mentioned profiled section,
wherein a heating wire is received in the mounting.
The afore-mentioned profiled section,
wherein the profiled section (10) furthermore has a groove (70) for receiving (20) an illumination means (250);
wherein the groove (70) is open toward the end face (15).
The afore-mentioned profiled section,
wherein the groove (70) extends in the same direction as the receptacle (20) or the receptacles (20, 40).
The afore-mentioned profiled section,
wherein an illumination means (250) is disposed in the groove (70).
The afore-mentioned profiled section,
wherein the illumination means (250) is an LED illumination means.
The afore-mentioned profiled section,
wherein heat from the illumination means (250) or from the groove (70) is dischargeable by means of the pipe register (60).
The afore-mentioned profiled section,
said profiled section being configured as a cooling member of the illumination means (250).
The afore-mentioned profiled section,
said profiled section having a constant cross section.
The afore-mentioned profiled section,
said profiled section having a number of one or a plurality of retaining webs (25, 45) which extend in a direction counter to that of the end face (15).
The afore-mentioned profiled section,
wherein the profiled section (10) is configured from two materials or from more than two materials.
The afore-mentioned profiled section,
wherein the profiled section (10) is configured in two production steps or in more than two production steps.
A building element assembly (100), having
a building element (110);
an insulation assembly (150); and
a number of one or a plurality of profiled sections (10) as described above;
wherein the profiled sections (10) are fastened or suspended so as to be spaced apart from the building element (110) such that the insulation assembly (150) is disposed between the building element (110) and the profiled sections (10).
The afore-mentioned building element assembly (100),
wherein the building element (110) is a building ceiling, a concrete ceiling, a building wall, or a concrete wall.
The afore-mentioned building element assembly (100),
wherein the insulation assembly (150) is entirely or partially configured from foam material, from plastics material, as a filling (160), or from an insulation material (170)
The afore-mentioned building element assembly (100),
wherein the insulation assembly (150) is entirely or partially configured as an air space (180).
The afore-mentioned building element assembly (100),
wherein the building element assembly (100) has a number of one or a plurality of end plates (200);
wherein the end plates (200) bear on the contact faces (30, 50) of the profiled sections (10).
The afore-mentioned building element assembly (100),
wherein the end plates (200) and the profiled sections (10) conjointly form a downward visible side of the building element assembly (100).
The afore-mentioned building element assembly (100),
wherein the profiled sections (10) in terms of area account for between 8% and 100% of the building element assembly (100).
The afore-mentioned building element assembly (100),
wherein the insulation assembly (150) has a thermal transmission coefficient of 0.1 $W/m^2K$ to 10 $W/m^2K$.
The afore-mentioned building element assembly (100),
wherein a first pipe register (60) is disposed in the profiled sections (10).
The afore-mentioned building element assembly (100),
wherein a second pipe register (120) is disposed in the building element (110).
The afore-mentioned building element assembly (100),
wherein an electric heater (130) is disposed in the building element (110).
The afore-mentioned building element assembly (100),
said building element assembly (100) furthermore having a control installation for controlling the pipe registers (60, 120) and/or the electric heater (130).
The afore-mentioned building element assembly (100),
wherein the control installation in a hydraulic charging operation is configured for heating the building element (110) by means of the second pipe register (120).
The afore-mentioned building element assembly (100),
wherein the control installation in an electric charging operation is configured for heating the building element (110) by means of the electric heater (130).
The afore-mentioned building element assembly (100),
wherein the control installation in a backup heating operation is configured for retrieving thermal energy from the building element (110) by means of the second pipe register (120) and for thereby heating the profiled sections (10) by means of the first pipe register (60).

The afore-mentioned building element assembly (100), wherein the control installation in a hydraulic boosting heating operation is configured for heating the profiled sections (10) by means of the first pipe register (60), wherein the thermal energy required to this end is not obtained by means of the second pipe register (120).

The afore-mentioned building element assembly (100), wherein electric heating wires are configured in or on the profiled sections (10); and wherein the control installation in an electric boosting heating operation is configured for heating the profiled sections (10) by means of the heating wires.

The afore-mentioned building element assembly (100), wherein the control installation is configured for determining a boosting heating requirement and as a function thereof for activating, for deactivating and/or for controlling a boosting heating operation.

The afore-mentioned building element assembly (100), wherein the control installation is configured for determining a boosting heating requirement as a function of a room temperature below, above or beside the building element (110) and/or as a function of a thermal flow through the insulation assembly (150).

The afore-mentioned building element assembly (100), said building element assembly (100) having a number of one or a plurality of suspension devices (105, 106) by means of which the profiled sections (10) are suspended on the building element (110).

The afore-mentioned building element assembly (100), said building element assembly (100) having a number of one or a plurality of spacers (320) by means of which the profiled sections (10) are fastened above the building element (110) so as to be spaced apart from the latter The afore-mentioned building element assembly (100), said building element assembly (100) having a number of one or a plurality of spacers by means of which the profiled sections (10) are fastened beside the building element (110) so as to be spaced apart from the latter.

The afore-mentioned building element assembly (100), wherein the electric heater (130) is configured as a heating layer.

The afore-mentioned building element assembly (100), wherein a further insulation assembly (300) is configured above the building element (110) and/or opposite the insulation assembly (150).

The use of a building element assembly (100) as described above, wherein basic temperature-control is achieved by means of a thermal flow through the insulation assembly (150); and a desired room temperature is set by boosting heating.

The afore-mentioned use, wherein the boosting heating takes place by means of a pipe register (60) which runs through the profiled sections (10).

The afore-mentioned use, wherein the boosting heating takes place by means of a heating wire which is fastened to the profiled sections (10).

Even further aspects which may be independent aspects of the invention but may also be combined with other aspects disclosed herein will be described hereunder. This herein is the text of the priority application. Aspects which in the text hereunder are referred to as inventive do not necessarily have to be but may be inventive in terms of what has been described above.

The increase in the use of renewable energy resources in the course of the energy transition leads to ever greater fluctuations in the electricity grid. Attempts are being made to equalize said fluctuations by way of negative and positive "control energy". To this end, the focus nowadays is primarily on battery storage units and hydraulic pump storage power stations. However, the high requirement for thermal energy suggests that it is also expedient for energy to be thermally stored. The storage of electric energy as thermal energy in the building mass (power-to-heat) could gain particular importance herein. This also and in particular with a view to stabilizing the grid and gaining a higher level of self-sufficiency of buildings. In all industrialized countries, building mass is moreover available almost without limits, in particular as existing buildings. Several sets of issues and challenges are to be overcome herein.

Constructing a construction element which at least meets the current requirements set for the construction of ceilings and/or floors.

The thermal utilization of the building mass as a storage without excessive heating/excessive cooling of the room temperature arising (in the case of heating/cooling).

Incorporating internal thermal building loads, for example from lighting and utilization, into the storage mass.

Incorporating external thermal building loads, for example from solar radiation, convection, transmission, etc., into the storage mass.

Utilizing environmental energy by way of solar heat/cooling of photovoltaic systems/(external) air absorbers.

Ensuring a discharge of the thermally utilized storage mass in a manner capable of regulating so as to avoid any thermal undershoot/overshoot in rooms/buildings.

Functional implementation. In particular as a drywall solution having an integrated cavity (installation/ventilation stage, etc.) and/or for renovations.

Activating the existing building mass.

The idea of utilizing the building mass as thermal storage, in particular for the utilization as "negative control energy" is not novel. In particular, known technologies such as "concrete core activations", "wall/floor board or soil storage systems" have already been made available to the market (cf. DE 10 2010 014 863 A1, DE 20 2014 000 931 U1, for example). It has been shown herein that classic concrete core activations, which have been known since the 1970s, fail as "active" storage, having to some extent significantly increased system temperatures because of the overshoot/undershoot in the room ("extremely problematic", according to Fraunhofer), just as "excessively insulated" concrete core activations do. In contrast, wall storage leads to a significantly increased space requirement and can be embodied only in the case of "heavy" walls. The latter can moreover have a negative influence on the statics. Moreover, the available wall surface of internal walls does not inevitably increase proportionally with a number of floor levels. Soil storage systems store thermal energy at low temperatures. Raising said temperatures, for example by heat pumps, represent an additional, also energetic, input. Also, as is the case in floorboard storage and optionally wall storage systems, the mass does not increase proportionally to the number of floor levels. All these solutions cannot be implemented as a retrofit, or if at all implemented only with great complexity and therefore in a highly uneconomical manner.

It is an objective of the invention proposed here to present to the market a high-performance concept which at the same time is simple and optimized in terms of costs as well as energy.

Proposed therefore in a first embodiment is a component in equal measures which represents an LED light and/or an LED cooling member but additionally configures a thermally effective component, for example as a profiled section and/or a rail which is passed through by a flow of a fluid in at least one cavity/pipe. This profiled section/rail herein can per se be in contact with a building element (for example a concrete ceiling) which serves as a mass storage, and direct the exhaust heat of the LEDs or of other thermal inputs directly into this mass storage, or the latter takes place by way of a fluid which directly, indirectly, or by way of the intervention of at least one heat exchanger or/and a hydraulic turnout, flows through the mass storage.

The discharging of the mass storage can take place in the reverse order. The transmitted thermal flow which makes its way from the storage into the room herein is damped by a potential second underslung ceiling which additionally can preferably but not mandatorily contain an electric heating in known construction modes (for example at least one heating cable) and/or a fluid-conducting system of at least one pipe or one cavity, on account of which the storage effect results. The electric or fluid-conducting additional system herein can be additionally activated for increasing the response time and/or the overall output, even sporadically, as required, or at all times.

The storage effect can be increased by additional insulation tiers which according to the invention are also situated in a cavity which from the underslung ceiling is incorporated or injected in the one, and the storage mass, for example a ceiling on the other side, and/or by higher temperature differentials. Insulation tiers can also be attached directly to the concrete ceiling.

Of course, the underslung ceiling can at least partially be in contact with the building mass, without any further spacing. A direct introduction/dissipation of the energy from the "ceiling extension" into the building body, or from the thermally activated mass into the "ceiling extension" is possible on account thereof (thermal equalization by contact).

In a particularly advantageous configuration, the underslung ceiling, or the ceiling extension, respectively, per se represents a heat-insulating plane. This however can also take place by way of ceiling components which are suspended or hooked in place, or else by ceiling components which are placed on top or clamped, for example. It has been found to be particularly advantageous when the heat-insulating plane additionally contains at least one element which contains at least one cavity or pipe circuit which is passed through by a flow of a fluid, and/or at least one electrical element for heating, and/or represents the component of the system which for transmission (immission or emission) communicates with the storage. In a further embodiment, the additional acoustically effective configuration of the underslung ceiling/ceiling extension which optionally also can form a reversible access to the cavity lying thereabove is seen to be an advantageous refinement.

According to the invention, the static discharge which is based on transmission is ascertained by a dynamic building simulation and determined such that any thermal undershoot or overshoot of the rooms is avoided in that the transmission performance is limited to approx. 70% of the heating requirement. The exact data herein is derived from the simulation and may to some extent significantly vary.

The performance deficit of, for example, 30% which results from the basic design according to the "transmission performance" is covered according to the invention by way of a second pipe register which faces the room to be temperature-controlled and is preferably situated in the underslung ceiling. Sporadically increased performances such as are derived from additional heating performances or additional cooling performances can be covered by way of this second pipe register. The energy supply of the second pipe system is preferably fed with thermal energy from the storage mass, the latter being made available by way of direct "purging" or/and by way of heat exchangers or/and by way of buffer storage units/hydraulic turnouts, etc. Additional heating performances can be provided in a likewise preferred embodiment when the underslung ceiling, additionally to the fluid-conducting circuit, contains an electrical component such as at least one electrical heating tape or other known systems for heating. In principle, the impingement of the profiled sections with electric current is possible according to the invention in order for said profiled sections to be heated, if this takes place in an isolated environment ensured according to known technologies, for example.

It has been established according to the invention that it is particularly advantageous when the underslung ceiling is composed of profiled sections having at least one fluid-conducting cavity or pipe, at least one electrical component, and at least one (known) illumination means (for example LED, OLED, etc.).

In one particular embodiment of the profiled section, the same element as a profiled section in an underslung ceiling which may also be directly screw-fitted and is effective in relation to the room facing said element (immission/emission/light/acoustics/moisture absorption/moisture adsorption) AND/OR as a profiled section which is effective in relation to a storage mass, for example a concrete ceiling, and thermally charges said storage mass by way of the electrical component ("power to heat", negative control energy), or charges or discharges the fluid-conducting cavity, respectively. This preferred embodiment in a further construction mode permits at least one acoustically effective and thermally insulating construction material element to be placed thereon or therein. In the case of this variant, it is advantageous according to the invention for the profiled section to be coated and visibly installed so as to make available to the room the thermal output (emission/immission) at the maximum effect thereof. In this embodiment, the created reversibility of a behind the underslung ceiling is to be considered as particularly advantageous.

In a further variant, when the mass of the concrete ceiling, for example, that is situated above the underslung ceiling is thermally activated, the use of construction elements which in the In one variant of this preferred construction mode, the illumination means (for example the LED) as independent component, or particularly preferably in this profiled section, is situated so as to be "seated" in a bead which can also receive screws simultaneously by way of which the profiled section can be directly screwed to a substructure, or the profiled sections can be screwed to another profiled section, also of the same type of construction. When the profiled section in this preferred type of construction contains at least one additional groove for receiving at least one electrical component, it is particularly advantageous for the delimitation of this groove to simultaneously serve as a component for receiving a connection means and/or or statically reinforcing the profiled section overall.

According to the invention, it also proves advantageous for the building mass (for example the ceiling) by way of a floor construction, also referred to as a cavity floor or a double floor, which is spaced apart by a thermal separation tier and which by way of a support structure (also support spindles) supports the above-described profiled rail. The construction of a cooling floor created on account thereof is considered to be particularly advantageous because incoming solar radiation is directly absorbed, this leading to particularly positive performance values while simultaneously avoiding cold feet. Of course, the energy extracted from the room can be supplied to the building mass.

The proposed construction thus for the first time ever shows a solution for thermally utilizing the building mass in a manner corresponding to how the desired storage performance in terms of the thermal behavior thereof correlates with the rooms. The invention herein is distinguished in that said invention can be applied in new builds as well as in prefabricated parts and also enables the activation of the building mass in existing buildings.

The proposals pertaining to "power to heat" in floor and suspended/underslung ceilings can be ideally combined with fluid-conducting systems. The responsive surface which faces the room and which according to the invention is thermally connected (directly/indirectly) with the activated building mass herein is suitable for the emission and immission of energy. Moreover, on account of the design embodiment of a thermally activated profiled rail system, all known types of ceiling construction boards can be used in the respective predominant construction technologies (placing, clamping, inserting, underside paneling, adhesive bonding, etc.). Moreover, the combination of the most varied building material features is enabled. The ceiling construction boards can thus be configured so as to be reversible, thermally insulating, acoustically effective, moisture-absorbing, etc. Of course, entire illuminated boards can also be used, or the profiled rail system can be provided with a false ceiling with the. The decisive factor herein is thermal connection of the room with the ceiling (false ceiling, suspended ceiling, ceiling extension, etc.) or the floor (cavity floor, double floor, dry screed/liquid screed) by means of radiation exchange and/or convection, and the discharge/supply of energy from an energy system which can be supported by the building mass, or in the context of "power to heat" is capable of stabilizing electric (also thermal) grids (control energy).

The claims which are filed at this point with the application and claims filed later are without prejudice to the purpose of achieving further protection.

Should it be found here upon closer examination, in particular also of the relevant prior art, that one feature or another, although advantageous, is not absolutely imperative in relation to the aim of the invention, then, of course, the attempt will be made to achieve a wording which no longer has such a feature, in particular in the main claim. Such a sub-combination is also covered by the disclosure of this application.

It should also be noted that the design embodiments and variants of the invention that are described in the various embodiments and shown in the figures can be combined with one another in any desired manner. It is possible for individual features, or a number of features, to be interchanged as desired. These combinations of features are likewise disclosed here.

The dependency references given in the dependent claims relate to the further development of the subject matter of the main claim by means of the features of the respective dependent claim. However, these should not be understood as obviating the need to achieve independent substantive protection for the features of the appended dependent claims.

Features which have been disclosed only in the description, or also individual features from the claims which comprise a number of features, can at any time be adopted in the independent claim/claims as being of importance which is essential for the purpose of distinguishing the invention from the prior art, to be precise even when such features have been mentioned in conjunction with other features or achieve particularly favorable results in conjunction with other features.

The invention claimed is:

1. A profiled section for temperature-controlling a room and supporting end plates, having:

a receptacle for retaining a pipe register, the receptacle having an opening for receiving the pipe register and being integrated with a contact face that defines a first surface of a planar portion;

an end face which is configured so as to be at least lateral to the receptacle and defining a second surface of the planar portion that is opposite the contact face;

the contact face further defining at least two contact face surfaces separated by the receptacle, the at least two contact face surfaces configured for each receiving an end plate so that each received end plate is disposed on the contact face of the planar portion opposite the end face, wherein the profiled section is an extruded profiled section, a rolled profiled section or a folded profiled section; and a plurality of retaining webs configured to facilitate attaching the profiled section to a structural component of the room and formed as a portion of the contact face between the two contact face surfaces and extending therefrom in a direction opposite the end face, wherein the end face is configured to form a downward-pointing visible face which can be seen from a room situated below the profiled section, and wherein the pipe register is disposed in the receptacle.

2. The profiled section as claimed in claim 1, wherein the profiled section furthermore has a mounting for a heating wire;

wherein a heating wire is received in the mounting.

3. The profiled section as claimed in claim 1, wherein the profiled section furthermore has a groove for receiving a light source;

wherein the groove is open toward the end face.

4. A building element assembly, having a building element;

an insulation assembly; and a number of one or a plurality of profiled sections as claimed in claim 1;

wherein the profiled sections are fastened or suspended so as to be spaced apart from the building element such that the insulation assembly is disposed between the building element and the profiled sections.

5. The building element assembly as claimed in claim 4, wherein the insulation assembly is entirely or partially configured from foam material, from plastics material, as a filling, or from an insulation material; and/or wherein the insulation assembly is entirely or partially configured as an air space.

6. The building element assembly as claimed in claim 4, wherein the building element assembly has a number of one or a plurality of end plates;

wherein the end plates bear on the contact faces of the profiled sections.

7. The building element assembly as claimed in claim 4, wherein the profiled sections in terms or area account for between 8% and 100% of the building element assembly.

8. The building element assembly as claimed in claim 4, wherein a first pipe register is disposed in the profiled sections; and/or wherein a second pipe register is disposed in the building element; and/or wherein an electric heater is disposed in the building element.

9. The building element assembly as claimed in claim 8, said building element assembly furthermore controlling the pipe registers and/or the electric heater;

wherein in a hydraulic charging operation the building element assembly controls heating the building element by using the second pipe register; and/or wherein in an electric charging operation the building element assembly controls beating the building element by using the electric beater; and/or wherein in a backup heating operation the building element assembly controls retrieving thermal energy from the building element by using the second pipe register, and for thereby heating the profiled sections by using the first pipe register; and/or wherein in a hydraulic boosting heating operation the building element assembly controls heating the profiled sections by using the first pipe register, wherein the thermal energy required to this end is not obtained by using the second pipe register.

10. The building element assembly as claimed in claim 4, wherein electric heating wires are configured in or on the profiled sections; and wherein in an electric boosting heating operation the building element assembly controls heating the profiled sections by using the heating wires.

11. The building element assembly as claimed in claim 4, wherein the building element assembly determines a boosting heating requirement and as a function thereof activating, deactivating and/or controlling a boosting heating operation.

12. The building element assembly as claimed in claim 4, wherein the building element assembly determines a boosting heating requirement as a function of a room temperature below, above or beside the building element and/or as a function of a thermal flow through the insulation assembly.

13. The use of a building element assembly as claimed in claim 4, wherein basic temperature-control is achieved by using a thermal flow through the insulation assembly; and a desired room temperature is set by using boosting heating by the pipe register which runs through the profiled sections, and/or by using a heating wire which is fastened to the profiled sections.

14. The profiled section of claim 1, further comprising:

a plurality of substantially parallel receptacles disposed on the contact face between the at least two contact face surfaces.

15. The profiled section of claim 1, further comprising:

a groove for receiving a light source, the groove disposed between two of the plurality of retaining webs and further defining a separation along the planar portion between the at least two contact face surfaces.

16. The profiled section of claim 1, further comprising: the receptacle disposed proximal to a first of the at least two contact face surfaces, a second receptacle disposed proximal to a second of the at least two contact face surfaces, and a groove for receiving a light source disposed between the first receptacle and the second receptacle.

* * * * *